US008251366B1

(12) United States Patent
Nathan et al.

(10) Patent No.: US 8,251,366 B1
(45) Date of Patent: Aug. 28, 2012

(54) CYLINDRICAL PUZZLE MECHANISM

(76) Inventors: Avraham Nathan, Ashkelon (IL); Itshak Christo Dimitrov, Ashkelon (IL); Gabriela Nathan, Ashkelon (IL); Mario Nathan, Ashkelon (IL)

( * ) Notice: Subject to any disclaimer, the term of this patent is extended or adjusted under 35 U.S.C. 154(b) by 0 days.

(21) Appl. No.: 13/153,627

(22) Filed: Jun. 6, 2011

(51) Int. Cl.
*A63F 9/08* (2006.01)

(52) U.S. Cl. ..... 273/153 S

(58) Field of Classification Search ..... 273/153 S, 273/156, 157 R
See application file for complete search history.

(56) References Cited

U.S. PATENT DOCUMENTS

| | | | | | |
|---|---|---|---|---|---|
| 4,382,601 | A * | 5/1983 | Dezsi | 273/153 S |
| 4,632,399 | A | 12/1986 | Bern et al. | |
| 4,651,992 | A | 3/1987 | Danino et al. | |
| 4,949,969 | A * | 8/1990 | Johnson | 273/153 S |
| 5,074,561 | A * | 12/1991 | Johnson | 273/153 S |
| 5,083,788 | A * | 1/1992 | Conotter | 273/153 S |
| 5,116,053 | A * | 5/1992 | Blankenburg et al. | 273/153 S |
| 5,884,912 | A * | 3/1999 | Ignatiev | 273/153 S |
| 7,025,351 | B2 * | 4/2006 | Christensen | 273/153 S |
| 7,275,744 | B1 * | 10/2007 | Kuo | 273/153 S |
| 2006/0061033 | A1 * | 3/2006 | Han | 273/153 S |
| 2010/0213669 | A1 * | 8/2010 | Kim et al. | 273/153 S |
| 2011/0057387 | A1 * | 3/2011 | Yang | 273/153 S |

* cited by examiner

*Primary Examiner* — Steven Wong
(74) *Attorney, Agent, or Firm* — Michael J. Feigin, Esq.; Feigin & Associates, LLC

(57) ABSTRACT

A cylindrical puzzle mechanism comprising a central shaft member, with at least two wheels mounted on the shaft member, and a plurality of puzzle components disposed along the outer circumference of each wheel. Each of the wheels is independently rotatable about the shaft member. A cylindrical frame is positioned concentrically around the wheels. The frame is rotatable about the wheels and shiftable along the axial direction of the shaft member. The frame comprises at least one driving element at each longitudinal end for shifting a longitudinally aligned row of puzzle components along an axial direction. Two rotatable stoppers for preventing each of the wheels from shifting axially along the shaft, is mounted on the shaft. The stoppers comprise at least one track for receiving a puzzle component thereon. A cap at each end of the shaft member prevents the stoppers from shifting axially along the shaft and for regulating the axial movement of the cylindrical frame.

28 Claims, 22 Drawing Sheets

CYLINDRICAL PUZZLE MECHANISM

FIELD OF THE INVENTION

The present invention relates to the field of puzzles. In particular, the present invention relates to the field of mechanical puzzles. More particularly, the present invention relates to a cylindrical mechanical puzzle having puzzle components that can rotate about a central axis and can shift in an axial direction.

BACKGROUND OF THE INVENTION

There exist a wide range of puzzle mechanisms in which various pieces or elements of one or more different shapes, colors, symbols etc. are required to be arranged in a predetermined pattern, often relative to other pieces or elements, in order to solve the puzzle. Puzzles range in difficulty and complexity, such that some may be suitable for a young child, and others, only for an advanced mathematician.

Some two dimensional puzzles consist of a plurality of puzzle components positioned within a frame in a rectangular arrangement, making up a table of columns and rows. One square in the table is missing to allow an adjacent puzzle component to be shifted into that space, thereby opening up the space on the table where the component was shifted from, for shifting a different puzzle component therein. Each puzzle component comprises an indicium such as a portion of a pattern or picture. By shifting each puzzle component as described, a predetermined pattern may be formed to solve the puzzle.

Three dimensional puzzles are also well known, particularly the Rubik's cube, comprising a cube shape, wherein each of the six faces is divided into nine squares. Each square has a colored indicium (e.g. a sticker) on it, and each square may be relocated to another face via rotational movement of a section of the cube. The puzzle is solved by arranging all the squares of a face with the same color indicia, such that each face shows a different color.

There exist a number of prior art puzzle mechanisms that attempt to combine the two forms of puzzles described above, however, each prior art mechanism has drawbacks associated with it.

U.S. Pat. No. 4,651,992 to Danino et al. discloses a puzzle-type game comprises at least five manipulatable members, for example of square or circular cross-section, each formed at one end with fingers, and at the opposite end with a circular recess, such that a plurality of the members may be assembled by the player according to any desired sequence, and to be rotated to any desired angular position with respect to each other. Each member carries on its outer faces indicia representing one element of a valid multi-element relationship produced only when the indicia of all the members are aligned according to a predetermined sequence and a predetermined angular position. In one described example, the indicia represent arithmetical equations, and in other described examples they represent the letters of the alphabet, and a maze.

The members of Danino's puzzle-type game are small and may become misplaced and lost when disassembled. Moreover, the specific representative indicium of each member is fixed such that indicia may not be transferred from one member to the next. This limits the level of difficulty as well as the number of arrangements that are required to solve the puzzle for each combination of members.

U.S. Pat. No. 4,632,399 to Bern discloses a manipulative puzzle in which a succession of coaxial wheel-like elements to be moved by a projective pattern to selectively exclude ones of these elements from a lot to be rotated in relation to the others. An embodiment has a disassembled configuration in which the various self-integrating parts comprise a semi-tubular limiter adapted for educational use in the assembly of a compact annular body from initially isolated elements, and an actuative projectional unit.

Bern's puzzle is conceptually similar to Danino's puzzle, however Bern's puzzle comprises a central shaft about which the wheel-like elements rotate. Since the indicia of each element must remain on its own element, the level of difficulty of patterns is limited, as described above.

U.S. Pat. No. 4,949,969 to Johnson discloses a self-contained cylindrical puzzle having a plurality of slide elements having faces displaying indicia. The elements form a mosaic geometric surface characterized by the absence of one of the elements leaving a slot. A slide element adjacent the slot may be slid into the slot, leaving behind a slot in the position from which the slide element was slid. Rotation of a row adjacent the row containing the slot will bring a new slide element adjacent the slot to be slid thereinto. Accordingly, the plurality of slide elements may be manipulated about so as to juxtapose indicia to bring about an overall composition that is a solution to the puzzle.

Johnson's puzzle is essentially a three dimensional (cylindrical) version of the framed two dimension puzzle described herein above, and as such, an empty space will always be present in the mosaic of the solution of the puzzle.

SUMMARY OF THE INVENTION

Accordingly, it is a principal object of the present invention to provide a three dimensional puzzle mechanism, which overcomes the difficulties and drawbacks associated with the prior art as described in part, herein above.

It is another object of the present invention to provide a three dimensional puzzle mechanism in the shape of a cylinder.

An additional object of the present invention is to provide a cylindrical puzzle mechanism comprising puzzle components that fill up the entire playing surface.

Yet another object of the present invention is to provide a cylindrical puzzle mechanism comprising puzzle components that may be transferred to different longitudinal and radial positions around the longitudinal central axis.

A further object of the present invention is to provide a cylindrical puzzle mechanism that requires little skill to learn how to manipulate.

Another object of the present invention is to provide a cylindrical puzzle mechanism that is lightweight and easily transportable.

Yet an additional object of the present invention is to provide a cylindrical puzzle mechanism that is inexpensive to manufacture.

Still another object of the present invention is to provide a cylindrical puzzle mechanism that consists of a handheld game.

In accordance with a preferred embodiment of the present invention, there is provided a cylindrical puzzle mechanism comprising a central shaft member and at least two wheels mounted on the shaft member. Each of the wheels is independently rotatable about the shaft member. A plurality of puzzle components is disposed along the outer circumference of each wheel.

A cylindrical frame is positioned concentrically around the wheels, wherein the frame is rotatable about the wheels and shiftable along the axial direction of the shaft member. The frame comprises at least one driving element at each longitudinal end for shifting a longitudinally aligned row of puzzle components along an axial direction.

Two rotatable stoppers are mounted on the shaft, near the opposite ends thereof, for preventing each of the wheels from shifting axially along the shaft, and comprise at least one track for receiving a driving element of the cylindrical frame and a puzzle component thereon. Also, a cap for grasping the puzzle mechanism is situated at each end of the shaft member for preventing the stoppers from shifting axially along the shaft, and for regulating the axial movement of the cylindrical frame.

Preferably, the outer circumference of the shaft member comprises a plurality of grooves extending along the longitudinal length of the shaft, and disposed around the outer circumference of the shaft. Each wheel comprises an alignment mechanism disposable within one of the grooves, for aligning longitudinal rows of puzzle components situated on the wheels. When rotating each wheel about the shaft, the alignment mechanism is alternatingly disposed within adjacent grooves.

Preferably, the alignment mechanism comprises a cantilever spring extending radially, coaxially within the wheel, and comprises a radial free end disposable within one of the grooves. Each wheel has an outer circumference comprising a plurality of tracks on which the plurality of puzzle components are mounted, such that one puzzle component is mounted on each of the tracks. Preferably, each wheel has an outer circumference comprising thirteen tracks. Preferably, the number of tracks on each wheel is equal to the number of grooves on the shaft.

The preferred embodiment of the puzzle mechanism of the present invention comprises four wheels.

When two tracks of adjacent wheels are axially aligned, puzzle components are slidingly shiftable along the tracks.

The cylindrical frame comprises first and second longitudinal ends, wherein each longitudinal end comprises a ring. The rings are spaced apart by at least two longitudinal frame members, thereby exposing the puzzle components of each wheel between the rings and the frame members. Preferably, at least one driving element is situated on the inner circumference of each ring, wherein each driving element on one ring is longitudinally aligned along an axial line parallel to the axis of the shaft, with a driving element on the other ring, for shifting a row of puzzle components along each of the longitudinally aligned axial lines. Preferably, between 2-6 driving elements are present on each ring. Preferably, each stopper comprises between 2-6 tracks, wherein the number of tracks on each stopper is equal to the number of driving elements.

The cross-sectional contour of the driving element is essentially the same as that of a puzzle component, for mounting on the track of a stopper. Similarly, the cross-sectional contour of the driving element is essentially the same as that of a puzzle component for mounting on the track of a wheel.

Each ring comprises at least one movement regulator for fixing the axial position and regulating the movement of the cylindrical frame.

Preferably, the cap comprises a large diameter portion and a small diameter portion, wherein a circumferential step is formed between the two portions. Each movement regulator regulates the axial movement of the cylindrical frame from the large diameter portion to the small diameter portion. The movement regulator comprises a flap portion cut out from each ring, wherein the flap portion comprises a small projection in contact with the step portion of the cap for maintaining the cylindrical frame in a middle position by preventing the cylindrical frame from shifting to the small diameter portion of the cap. When a sufficient amount of axial force is applied to the cylindrical frame in one axial direction, the at least one flap portion and projection bend inwards toward the central axis of the shaft, thereby allowing the cylindrical frame to shift to a shifted position wherein one end of the frame is in contact with the back wall of the cap.

The cap also comprises an extended central ring portion for preventing the stoppers from shifting axially along the shaft. Each longitudinal end of the shaft is coaxially affixed with the central ring portion of one of each cap.

Each stopper comprises at least one track for receiving a puzzle component that is slidingly shifted thereon when the at least one driving element of the cylindrical frame, axially shifts at least one row of puzzle components.

The longitudinal length of the track of the stopper is preferably the same as that of the driving element. Preferably, the longitudinal length of the track of the stopper is one and a half times the longitudinal length of the track of a wheel.

When the frame is in the middle position, each driving element is mounted on a respective track of the stopper, and when the frame is in the shifted position the driving element at one end of the frame is mounted on a track of a wheel and a track of a stopper, and the driving element at the other end of the frame is mounted on the track of the stopper.

When the cylindrical frame is axially shifted to the shifted position:

a. the puzzle component at a first longitudinal end of the aligned row of puzzle components is mounted on a track of the adjacent stopper;
b. the puzzle component at a second longitudinal end of the longitudinal row is mounted on a track of the wheel adjacent to the wheel on which the puzzle component at the second longitudinal end was mounted prior to the axial shifting of the cylindrical frame; and,
c. the driving element of the cylindrical frame at the second longitudinal end is mounted on a track of the wheel on which the puzzle component at the second longitudinal end was mounted prior to the axial shifting of the cylindrical frame;

wherein each wheel excluding the wheel on which the puzzle component at the second longitudinal end was mounted prior to the axial shifting of the cylindrical frame, is rotatable freely about the shaft.

Each stopper comprises an alignment mechanism disposable within one of the grooves of the shaft, for aligning along an axial line, the at least one track of one stopper with the corresponding track of the other stopper. When rotating the stoppers about the shaft, the alignment mechanism is alternatingly positioned within adjacent grooves. Preferably, the alignment mechanism comprises a cantilever spring extending radially within the stopper, and comprises a free end disposable within one of the grooves.

Additional objects and advantages of the invention will become apparent as the description proceeds.

BRIEF DESCRIPTION OF THE FIGURES

To accomplish the above and related objects, the invention may be embodied in the form illustrated in the accompanying drawings, attention being called to the fact, however, that the drawings are illustrative only, and that changes may be made in the specific construction illustrated and described.

DETAILED DESCRIPTION OF THE PREFERRED EMBODIMENTS

Figure 1A:
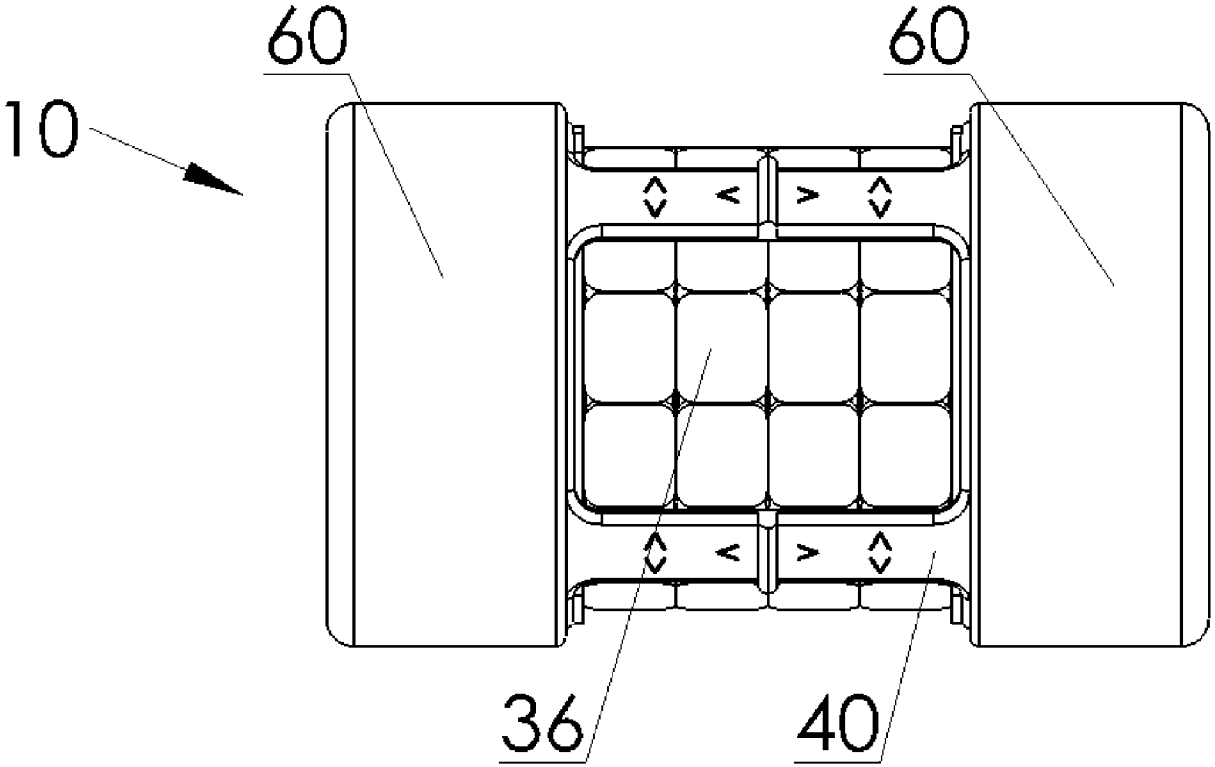
FIGS. 1*a* and 1*b* show an assembled view of the cylindrical puzzle mechanism of the present invention in a side view (FIG. 1*a*) and in a perspective view (FIG. 1*b*)
Figure 1B:
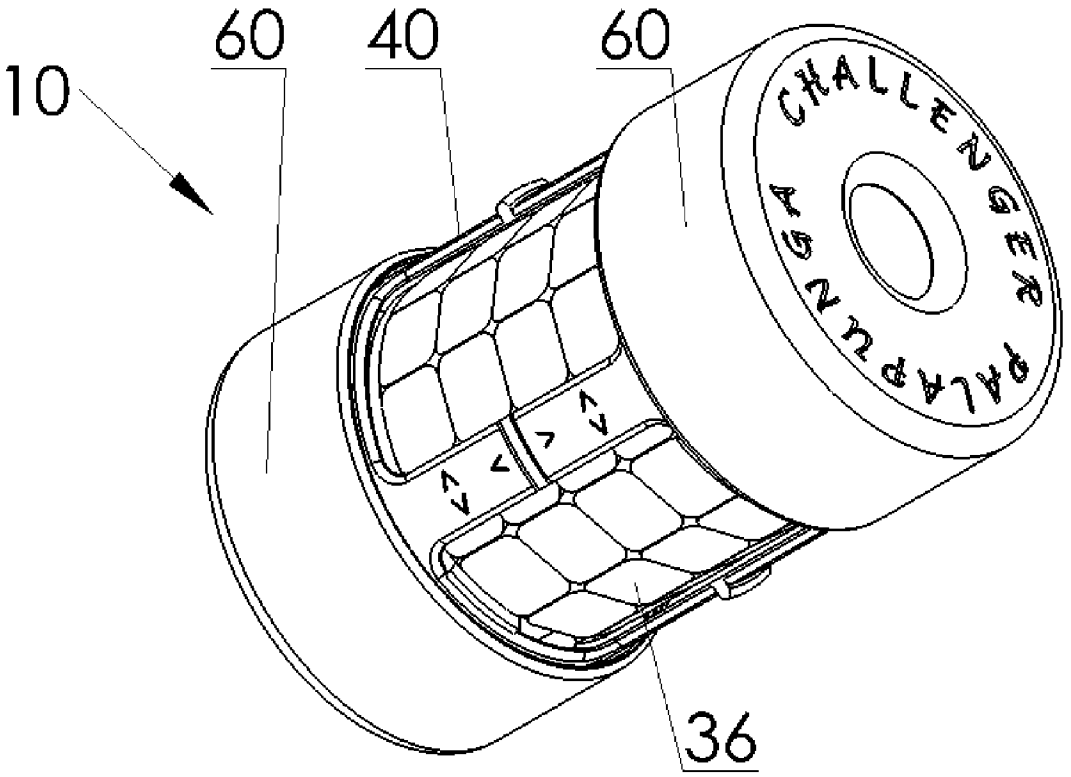
Figure 2:
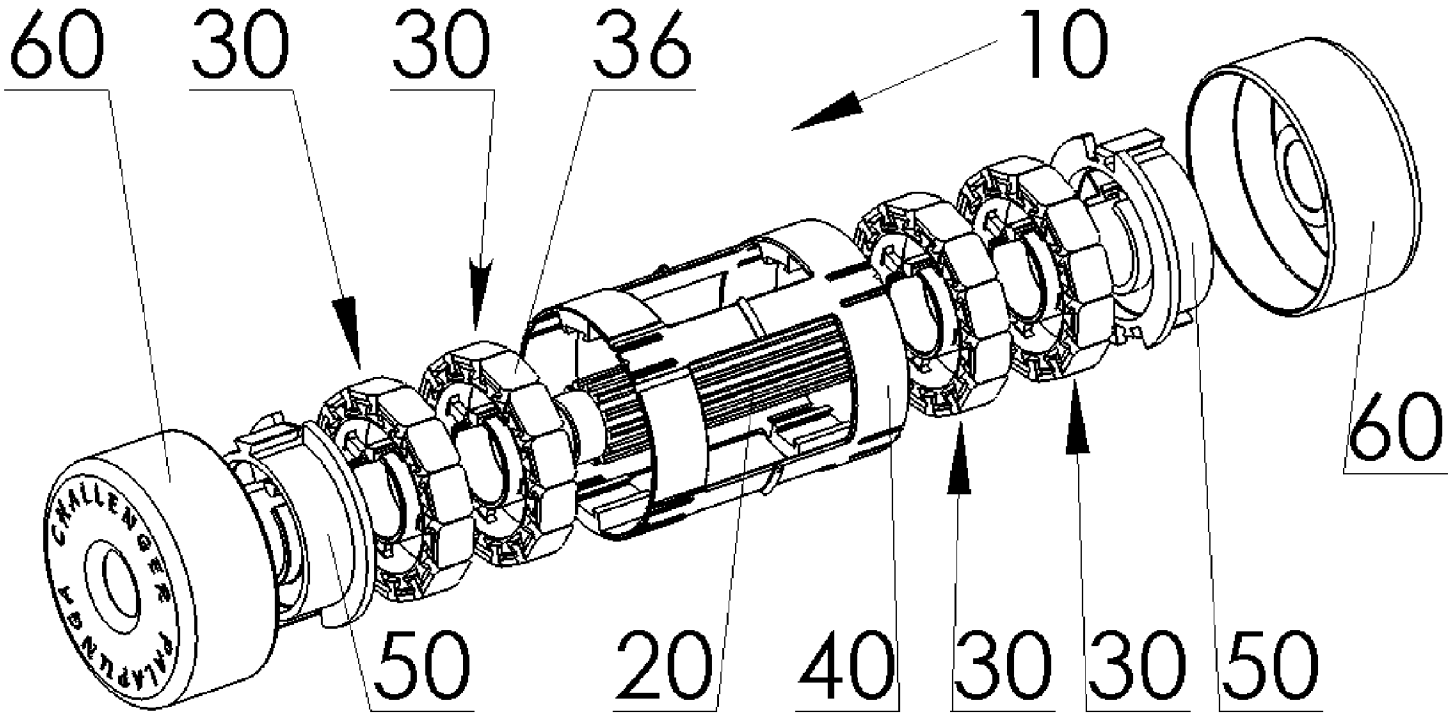
FIG. 2 shows the cylindrical puzzle mechanism of the present invention in an exploded view.

A preferred embodiment of the cylindrical puzzle mechanism of the present invention is shown assembled in FIGS. 1*a* and 1*b* in a side view (FIG. 1*a*) and in a perspective view (FIG. 1*b*), and in an exploded view in FIG. 2, and generally designated by the numeral (10). Referring particularly to FIG. 2, at the core of cylindrical puzzle mechanism (10) is a central shaft (20) that runs the longitudinal length of cylindrical puzzle (10). At least two wheels (30), although preferably more than two, such as four, as shown in the embodiment in the figures, are mounted on shaft (20). A plurality of puzzle components (36) is disposed along the outer circumference of each wheel (30). A cylindrical frame (40) is positioned concentrically around wheels (30) (see FIGS. 1*a* and 1*b*). Stoppers (50) are mounted near the ends of shaft (20) for preventing wheels (30) from shifting axially along shaft (20), and each end of shaft (20) is fixed within one of each end cap (60).

Figure 3:
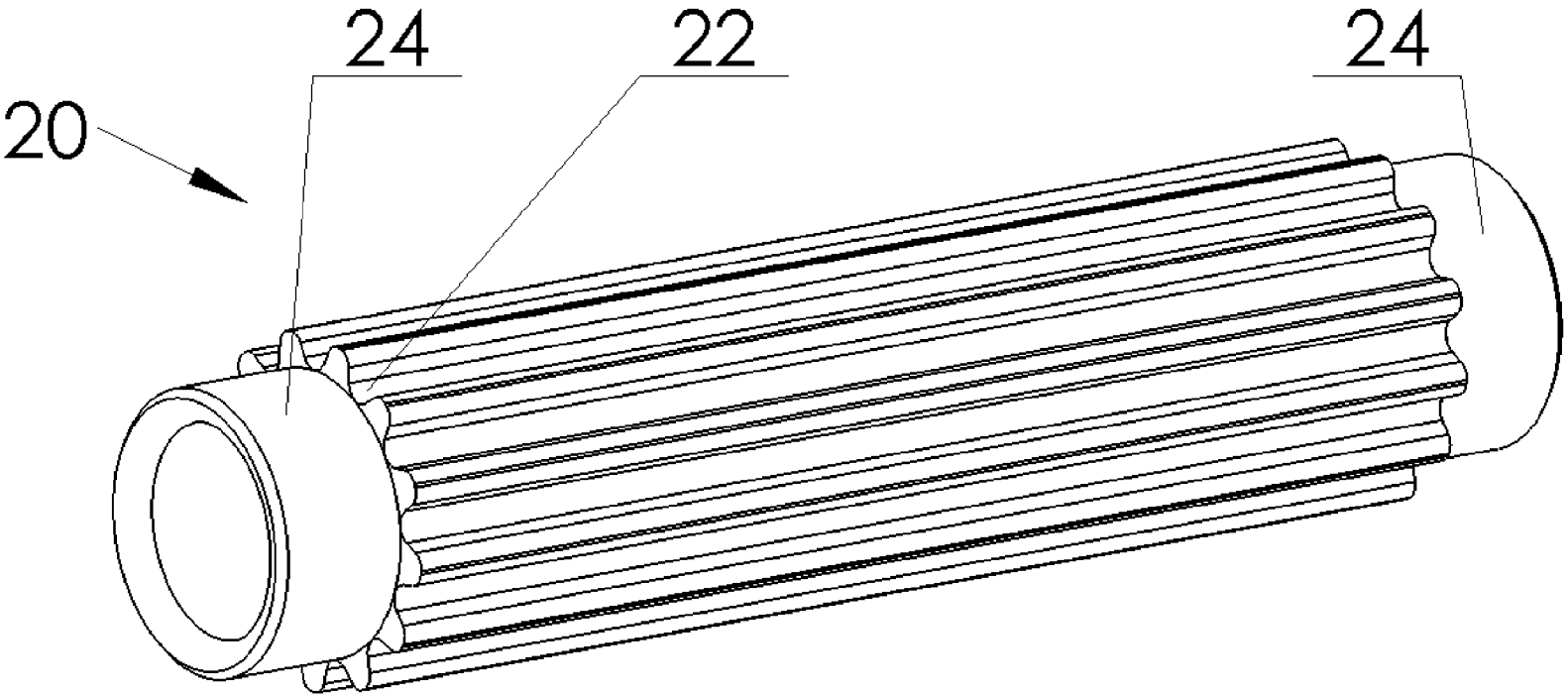
FIG. 3 shows an enlarged perspective view of the central shaft member of the cylindrical puzzle mechanism of the present invention.

Referring to FIG. 3, shaft (20) is shown enlarged in a perspective view, showing a plurality of grooves (22), each groove (22) extending along the longitudinal length of shaft (20), and disposed around the outer circumference of shaft (20), for accommodating the alignment mechanisms, as described herein below.

Figure 4:
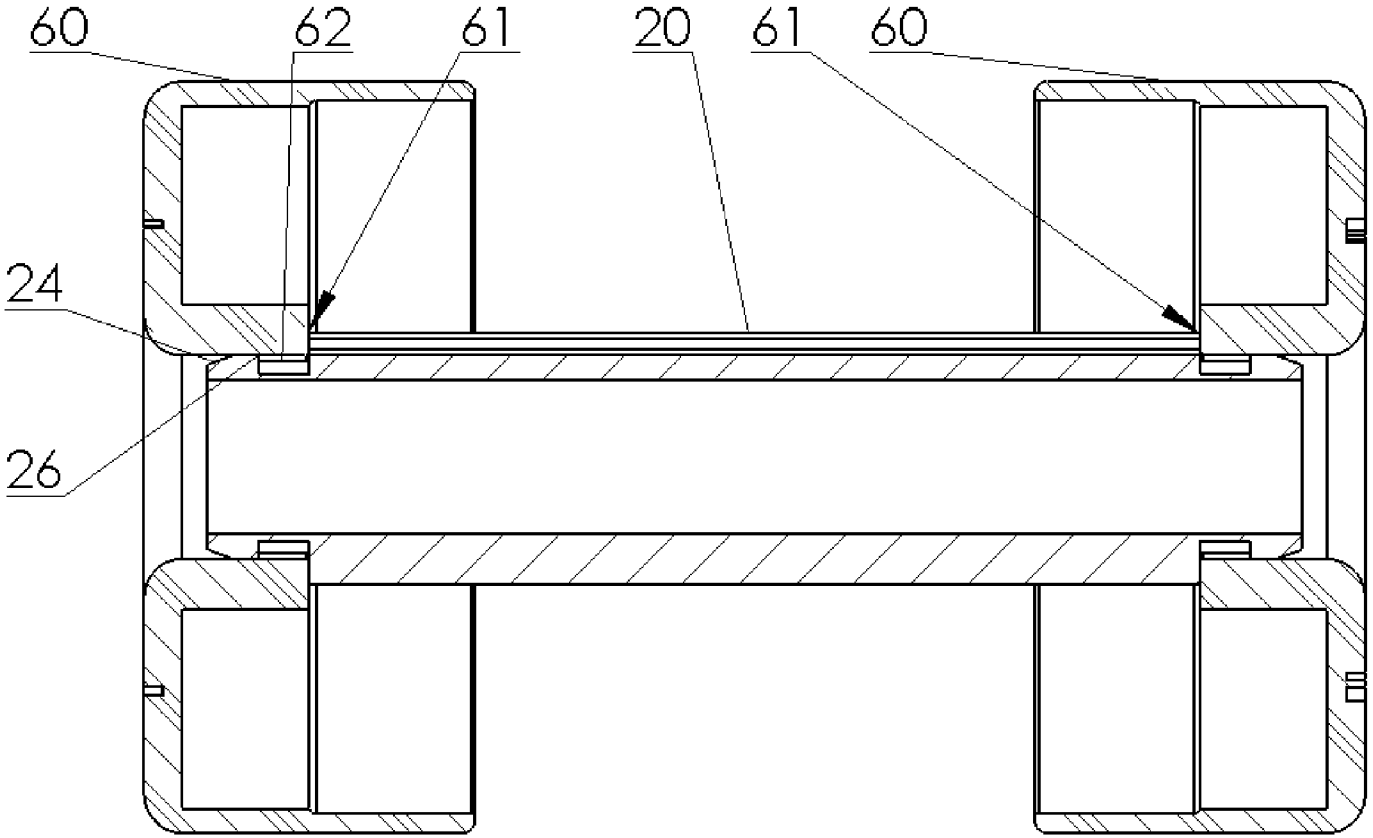
FIG. 4 shows a longitudinal cross-sectional view of the cylindrical puzzle mechanism of the assembled shaft and caps of the present invention.

FIG. 4 shows a longitudinal cross-sectional side view of shaft (20) assembled with caps (60), wherein all other components are removed for clarity. Each longitudinal end (24) of shaft (20) is fixed coaxially with a cap (60) at the extending central ring portion (61). According to the embodiment shown in the figures, each end (24) comprises a hook (26) for latching around a ridge (62) protruding inward toward the central axis of shaft (20). Alternatively, any suitable coupling means as known in the art may be utilized for fixedly joining ends (24) of shaft (20) with caps (60).

Figure 5:
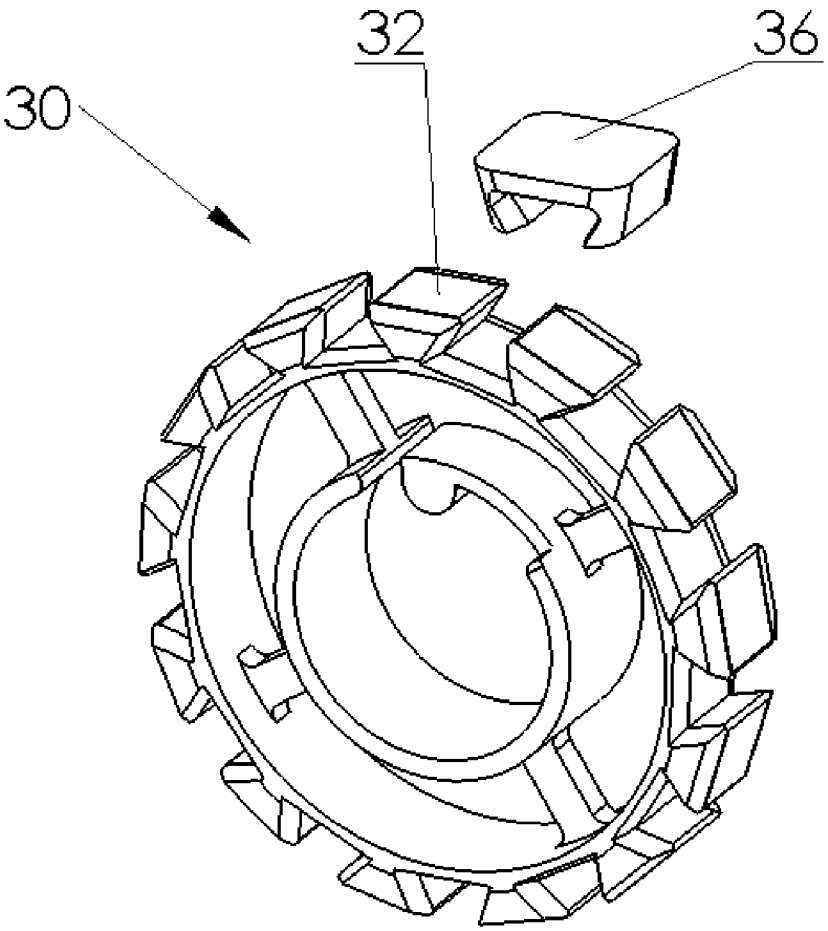
FIG. 5 shows a perspective view of a wheel and a separated puzzle component of the cylindrical puzzle mechanism of the present invention.
Figure 6A:
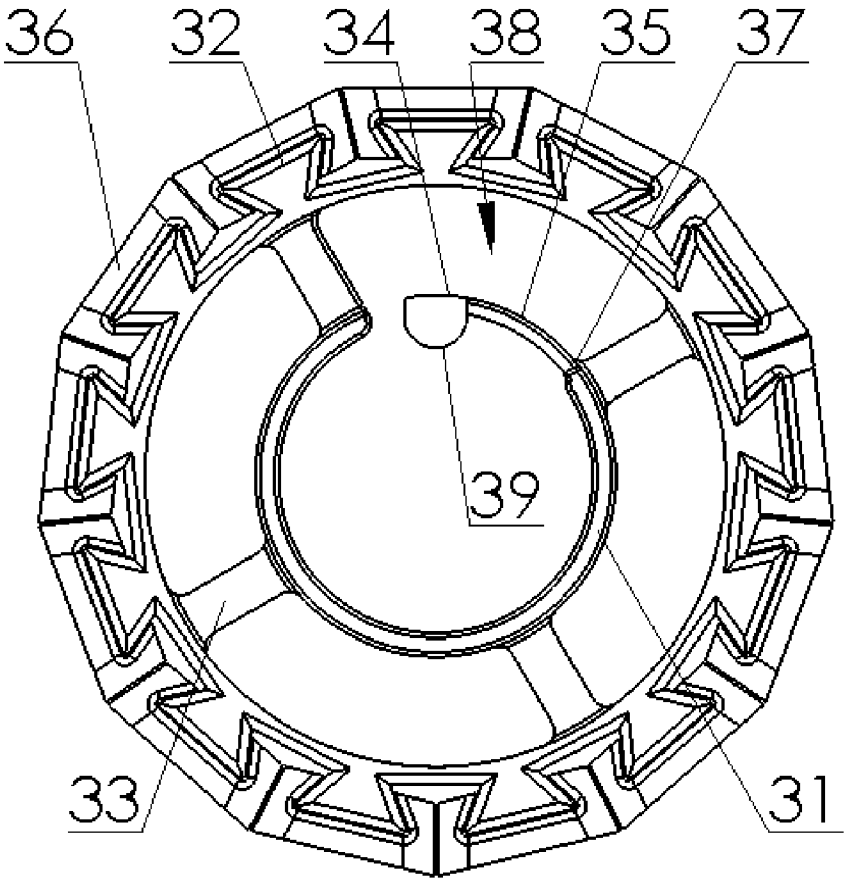
FIGS. 6*a* and 6*b* show a side view (FIG. 6*a*) and a perspective view (FIG. 6*b*) of a wheel of the cylindrical puzzle mechanism of the present invention with a puzzle component mounted on each track.
Figure 6B:
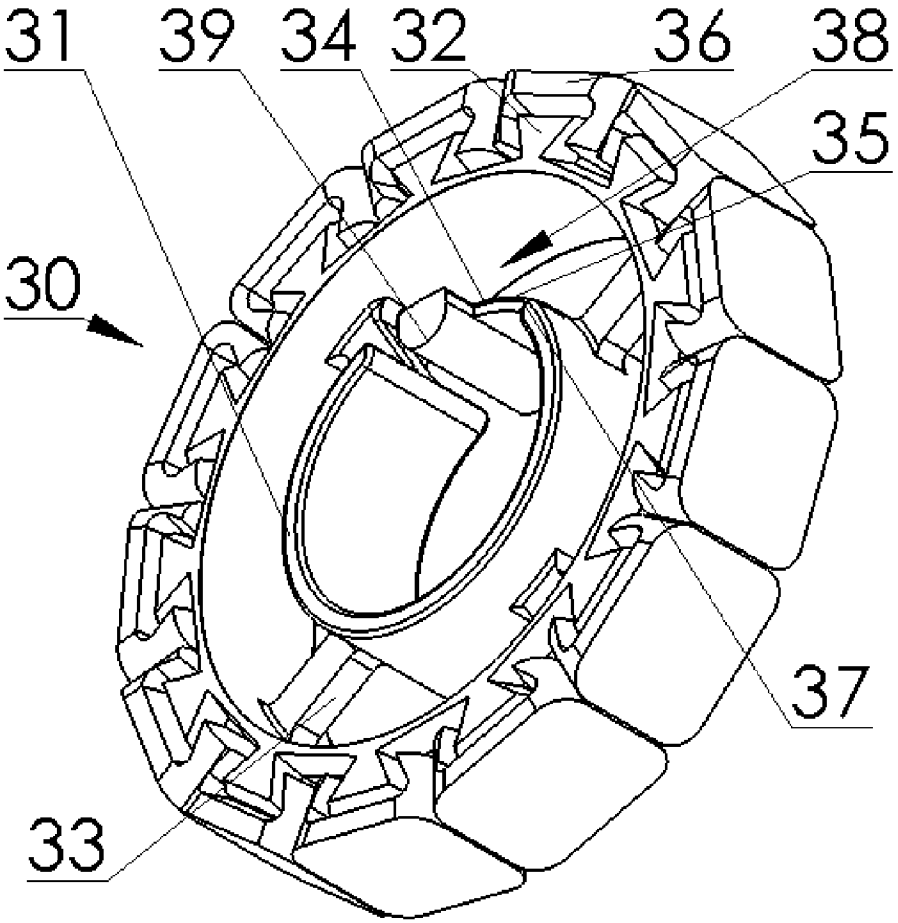

A wheel (30) is shown in FIG. 5 in a perspective view with a puzzle component (36) separated therefrom. Wheel (30) has an outer circumference comprising a plurality of tracks (32) for mounting a plurality of puzzle components (36) thereon, such that one puzzle component is mounted on each track (32). In FIGS. 6*a* and 6*b*, a wheel (30) is shown in a side view (FIG. 6*a*) and in a perspective view (FIG. 6*b*) with puzzle a component (36) mounted on each track (32) of wheel (30). In the preferred embodiment shown in the figures, each wheel (30) comprises thirteen tracks (32), however, a greater or fewer number of tracks may be present in different embodiments of the invention.

Still referring to FIGS. 6*a* and 6*b*, wheel (30) comprises an open inner ring (31) (i.e. wherein ring (31) is not fully closed to form a continuous circular shape) positioned concentrically within wheel (30) and held in place by four flanges (33) (although a fewer or greater number of flanges (33), or any suitable alternative means may be used). The alignment mechanism (38) of the preferred embodiment comprises a cantilever type spring (35), which extends along the radial curvature of open inner ring (31). Cantilever spring (35) has a fixed end (37) extending from one end of open inner ring (31) and a free end (34) comprising a knob (39) for disposing within one of the grooves of the shaft.

Figure 7:
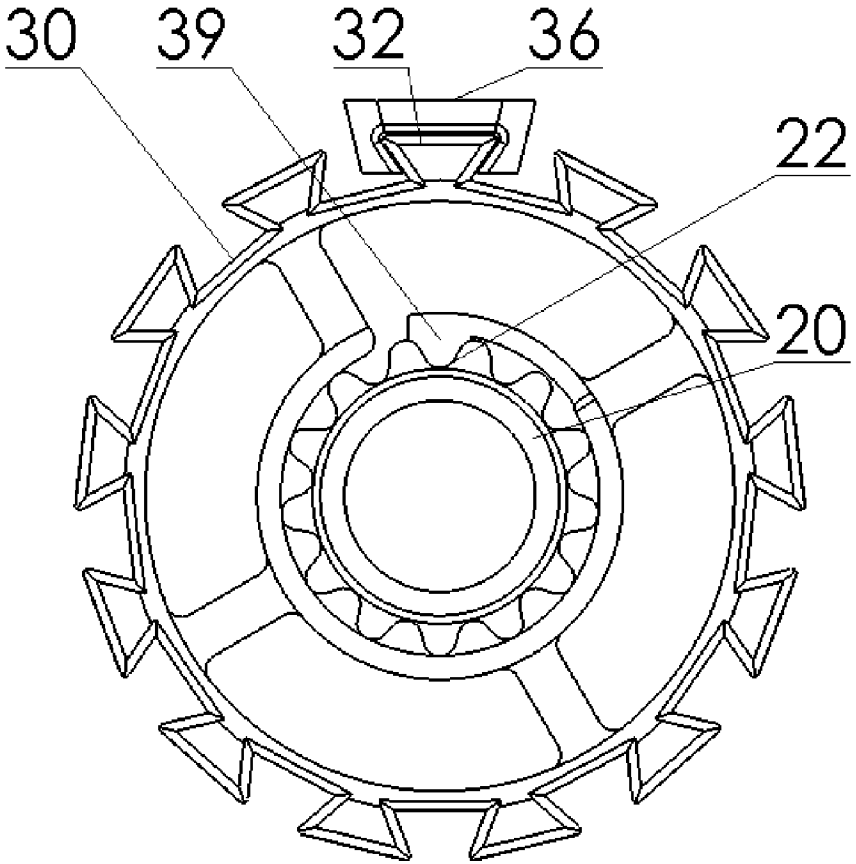
FIG. 7 shows a transverse cross-sectional view of the cylindrical puzzle mechanism of the present invention, taken along one of the wheels.

FIG. 7 shows a transverse cross-sectional view of a wheel (30) taken along wheel (30) wherein wheel (30) is mounted on shaft (20), and showing knob (39) disposed within a groove (22). Each wheel (30) is independently rotatable about shaft (20). When rotating each wheel (30) about shaft (20) as described further below, knob (39) is alternatingly disposed within adjacent grooves (22).

Figure 8:
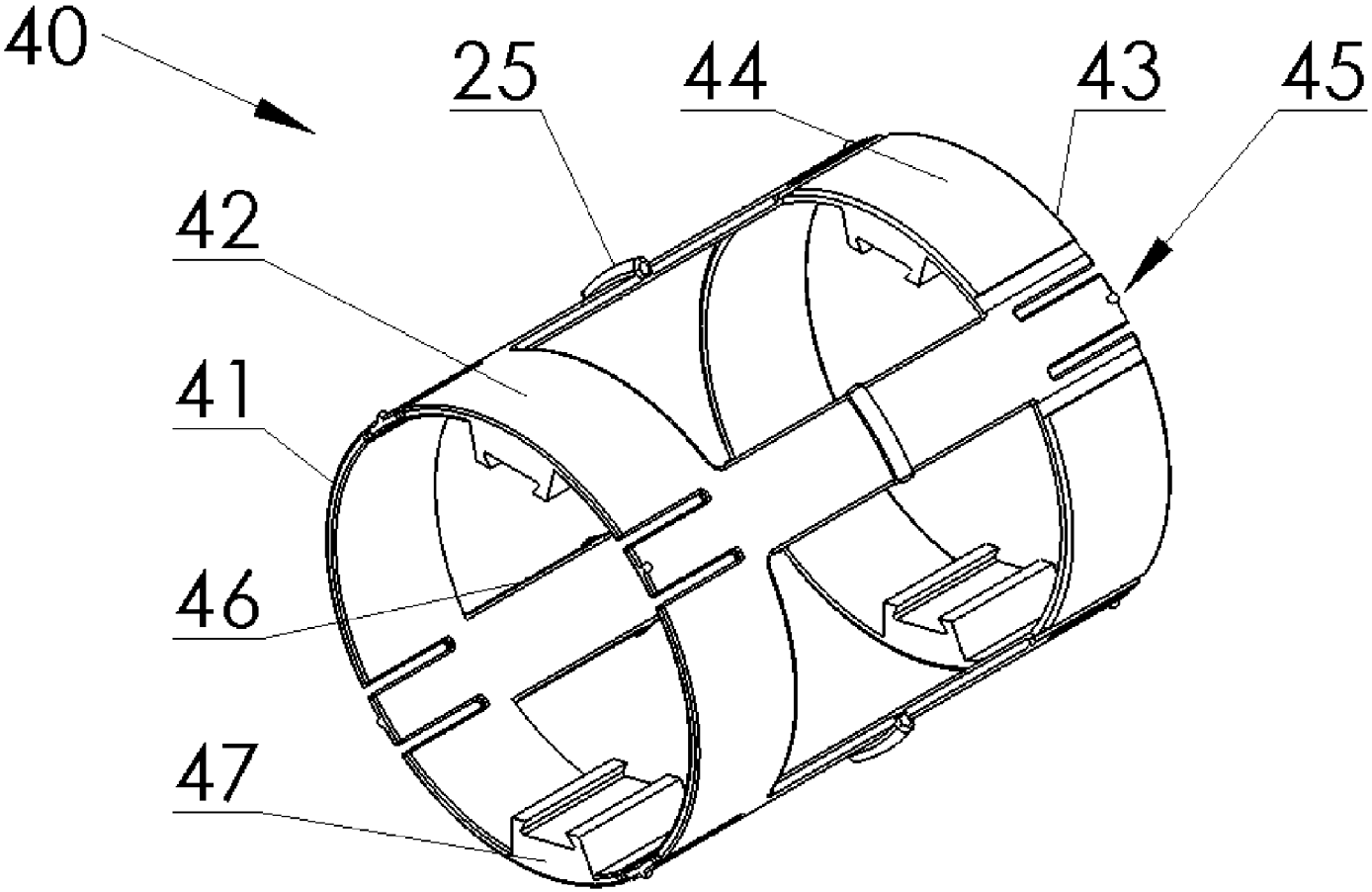
FIG. 8 shows a perspective view of the cylindrical frame of the cylindrical puzzle mechanism of the present invention.

With reference to FIG. 8, cylindrical frame (40) comprises first and second longitudinal ends (41), (43), wherein each longitudinal end comprises a ring (42), (44), respectively. First ring (42) and second ring (44) are spaced apart by at least two longitudinal frame members (46), (four are shown in the embodiment in the figures), thereby exposing the puzzle components of each wheel between rings (42), (44) and frame members (46), when assembled (see FIGS. 1*a* and 1*b*). A protrusion (25) from each frame member (46) provides leverage for the fingers of a user when shifting cylindrical frame (40) in an axial direction, as described herein below.

Each ring (42), (44) comprises at least one movement regulator (45) (preferably two, as shown) for regulating the axial movement of cylindrical frame (40), as described in further detail herein below.

When the puzzle mechanism is assembled, cylindrical frame (40) (together with stoppers (50)) is rotatable about the wheels and shiftable along the axial direction of the shaft member, as described herein below. At least one driving element (47) is positioned on the inner circumference of each ring (42), (44). Two driving elements (47) are present on each ring (42), (44) in the preferred embodiment as shown in the figures. In the preferred embodiment, wherein each wheel comprises thirteen tracks, the level of difficulty of operation of the puzzle mechanism increases as the number of driving elements increase, until six driving elements are present on each ring. When seven driving elements are present, the relative axial movement of the longitudinal rows of puzzle components compared with the stationary longitudinal rows of puzzle components is identical to that when six driving elements are present. When eight driving elements are present, the relative axial movement of the longitudinal rows of puzzle components compared with the stationary longitudinal rows of puzzle components is identical to that when five driving elements are present. And so on. Driving element (47) comprises the same cross-sectional contour as that of a puzzle component of the present invention, for aligning with and shifting a puzzle component, as described herein below. The longitudinal length of driving element (47) is longer than that of a puzzle component, and preferably one and a half times that of a puzzle component (and for that matter, one and a half times longer than a track of a wheel), as described further herein below. When the puzzle mechanism of the present invention is assembled, each driving element (47) on one ring (42) is longitudinally aligned along an axial line with one of each driving element (47) on the other ring (44), for axially shifting a row of puzzle components along each of the longitudinally aligned axial lines, as described herein below.

Figure 9A:
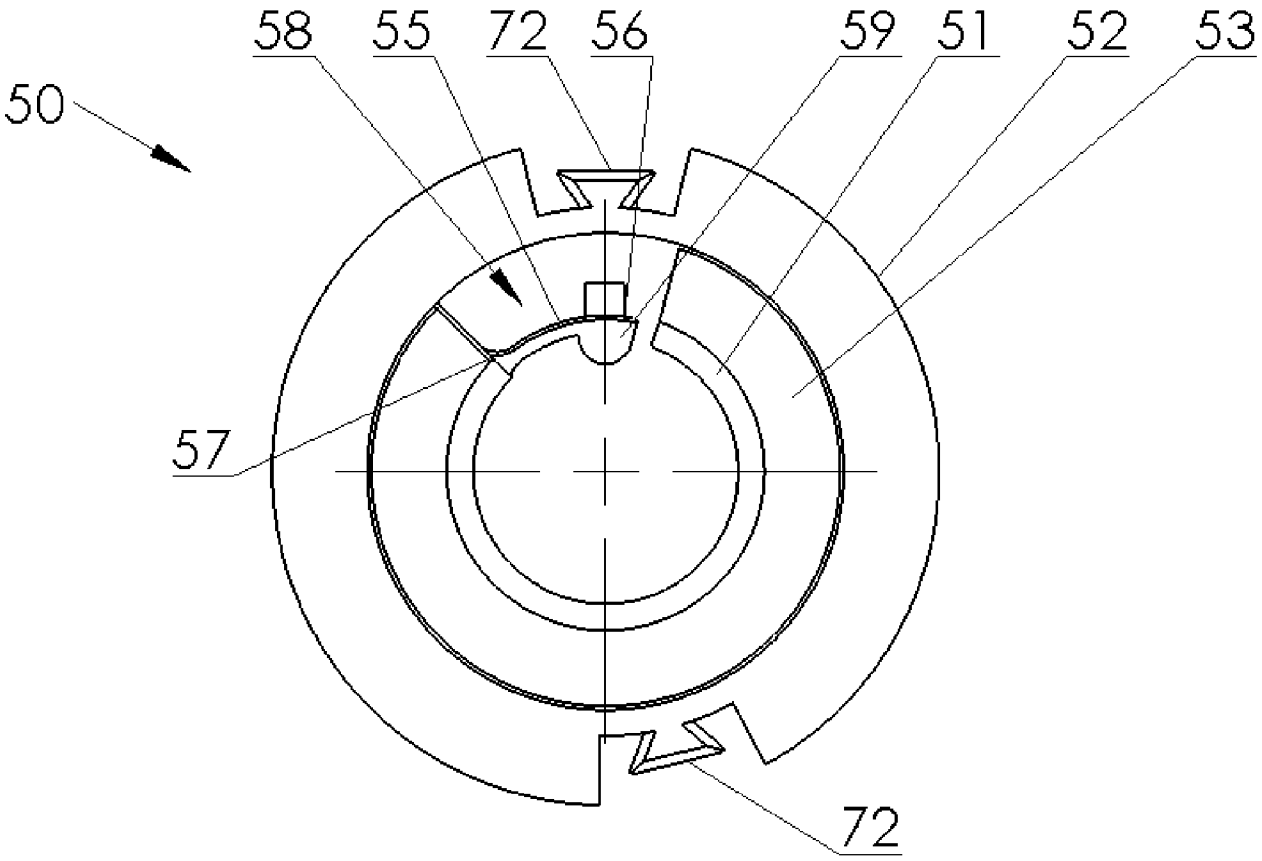
FIGS. 9*a* and 9*b* show a side view (FIG. 9*a*) and a perspective view (FIG. 9*b*) of the stopper of the cylindrical puzzle mechanism of the present invention.
Figure 9B:
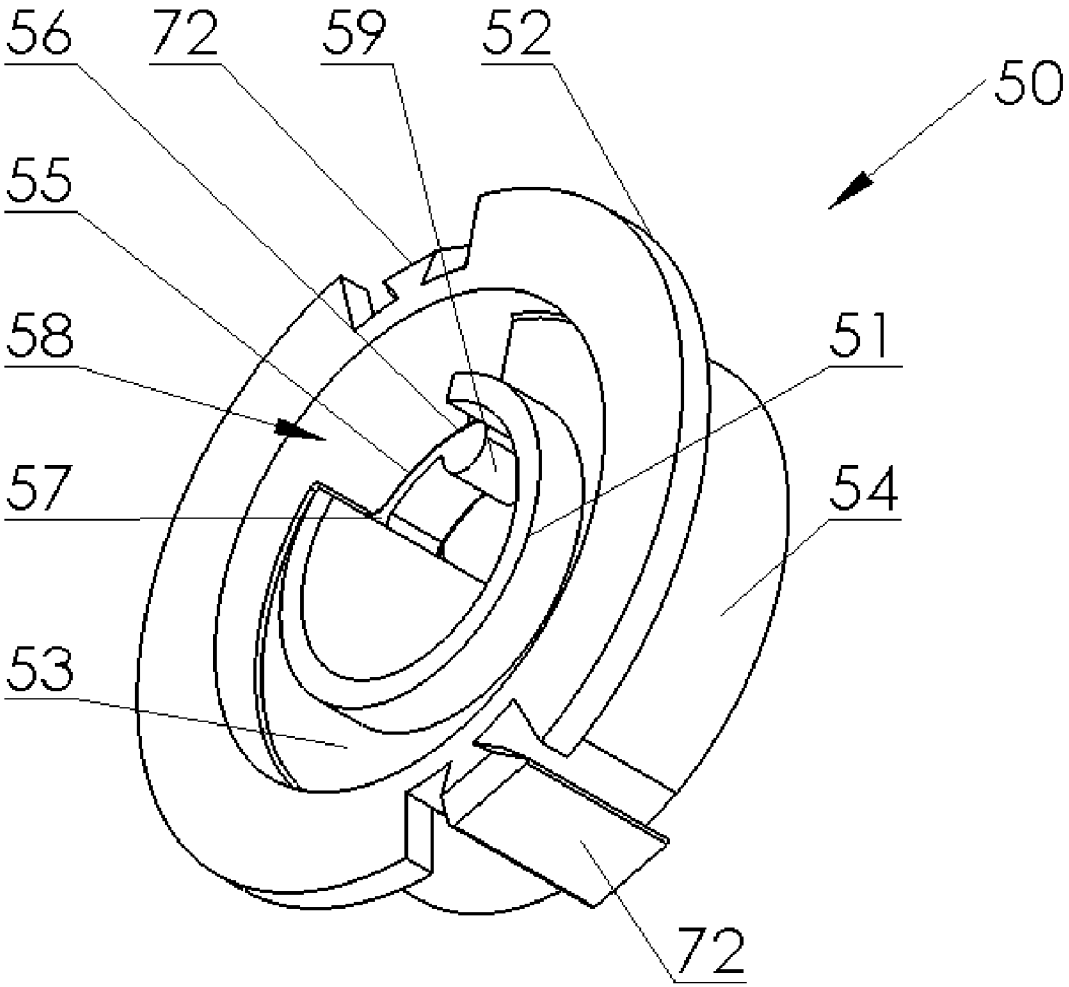
Figure 10:
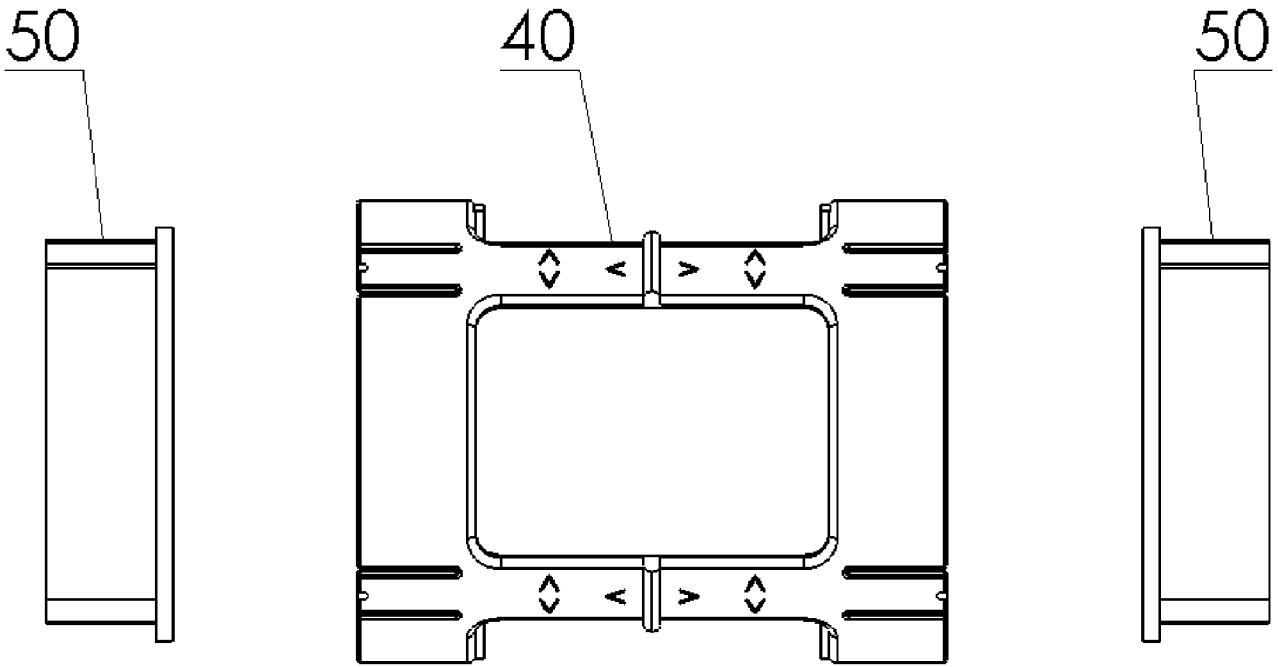
FIG. 10 shows a side view of the cylindrical frame and the stopper mechanisms of the cylindrical puzzle mechanism of the present invention.

Referring to FIGS. 9*a* and 9*b*, as well as to FIG. 2, a rotatable stopper (50) is shown in a side view (FIG. 9*a*) and in a perspective view (FIG. 9*b*), and comprises a smooth cylindrical inner circumference with small diameter (54) and large diameter (52) outer portions. When assembled, large diameter portion (52) is oriented toward the inner portion of the cylindrical frame (see FIG. 10), illustratively showing stoppers (50) spaced from frame (40)) for abutting the adjacent wheel (not shown). A small diameter portion (54) (see FIG. 9*b*), when assembled, is oriented toward the adjacent end cap, and is in contact with the extending central ring portion (61) (see FIG. 4). Stoppers (50) comprise an open inner ring (51) (similar to that of the wheels), positioned concentrically within stopper (50) and held in place by a circular panel (53) (although alternatively, flanges or other suitable means may be used). An alignment mechanism (58) of the preferred embodiment comprises a cantilever spring (55), which extends along the radial curvature of open inner ring (51). Cantilever spring (55) has a fixed end (57) extending from one end of open inner ring (51) and a free end (56) comprising a knob (59) for disposing within one of the grooves of the shaft, in a similar manner as described above regarding the alignment mechanism of the wheels.

The outer circumference of stoppers (50) comprises at least one track (72) for mounting the cylindrical frame (40) thereon, and for receiving a puzzle component when the at least one driving element of the cylindrical frame axially shifts the at least one longitudinally aligned row of puzzle components, as described further herein below. In the embodiment shown in the figures, two tracks (72) are shown. The longitudinal length of tracks (72) is the same as that of the driving element of the cylindrical frame, that is, preferably one and a half times that of a puzzle component, as described further herein below. It is understood that the greater number of tracks present on stoppers (50) increase the level of difficulty of the game. The number of tracks of the stoppers always are equal to the number of the driving elements situated on the cylindrical frame and always disposed on the same angular distances as the driving elements.

It should be noted that the angular distance between the two tracks (72) shown in the figures (see FIG. 9*b*) is nearly but not exactly 180 degrees. This is due to the number of tracks present in the embodiment shown in the figures (i.e. thirteen tracks), wherein 360 degrees is not evenly divisible by the number thirteen, thereby precluding tracks (72) from being situated symmetrically along the circumference, such as at the quadrants. In another embodiment the angular distance between the two tracks may be different than that of the present embodiment depending of the number of tracks.

Figure 17A:
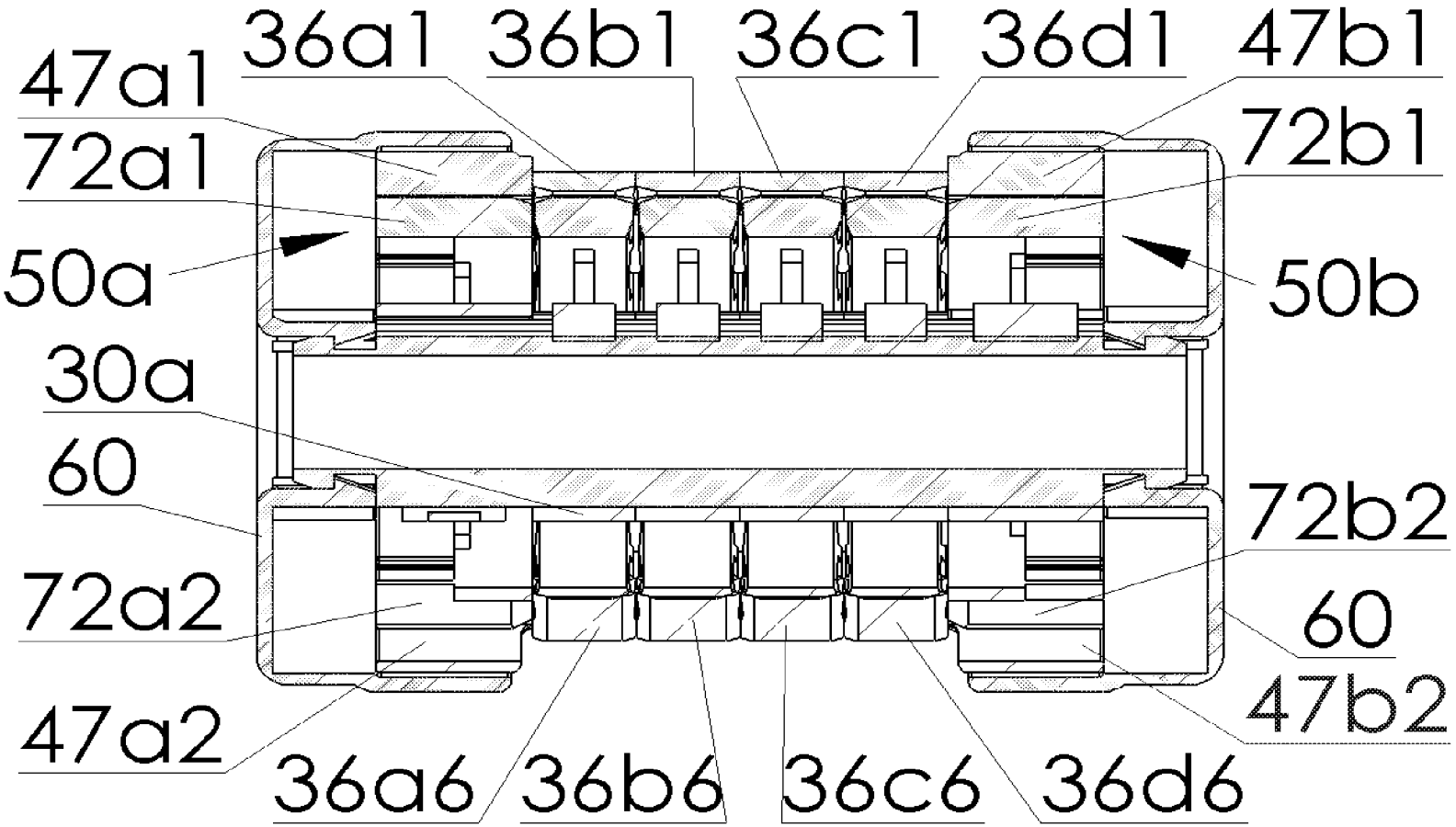

Referring to FIG. 17*a*, showing a longitudinal cross-sectional side view of assembled puzzle mechanism (10) in a middle (or, initial) position (also see FIG. 1*a*), wherein each driving mechanism (47*a*1, 47*a*2, 47*b*1, 47*b*2) of the cylindrical frame (not shown in the figure due to the cross-sectional cut) is mounted on one of each respective tracks (72*a*1, 72*a*2, 72*b*1, 72*b*2) of the stoppers (50), thereby coupling the cylindrical frame with stoppers (50*a*, 50*b*). Hence, when the cylindrical frame is rotated about the shaft, each stopper (50*a*, 50*b*) rotates concurrently about shaft (20) as well. When rotating the stoppers about shaft (20) as described further below, the knob of the stoppers is selectively disposed within adjacent grooves of the shaft.

Although not seen in the figures, the puzzle components of the cylindrical puzzle mechanism comprise indicia such as colors, shapes, letters, numbers, etc., which, according to the preferred operation of the present invention, must be arranged in a predetermined order to "solve" the puzzle. Each puzzle component may be transferred from one longitudinal row to another longitudinal row by rotating some of the wheels about the shaft relative to other wheels, and each puzzle component may be transferred from one wheel to another wheel by axially shifting longitudinal rows of puzzle components when aligned, as described herein below.

Figure 11:
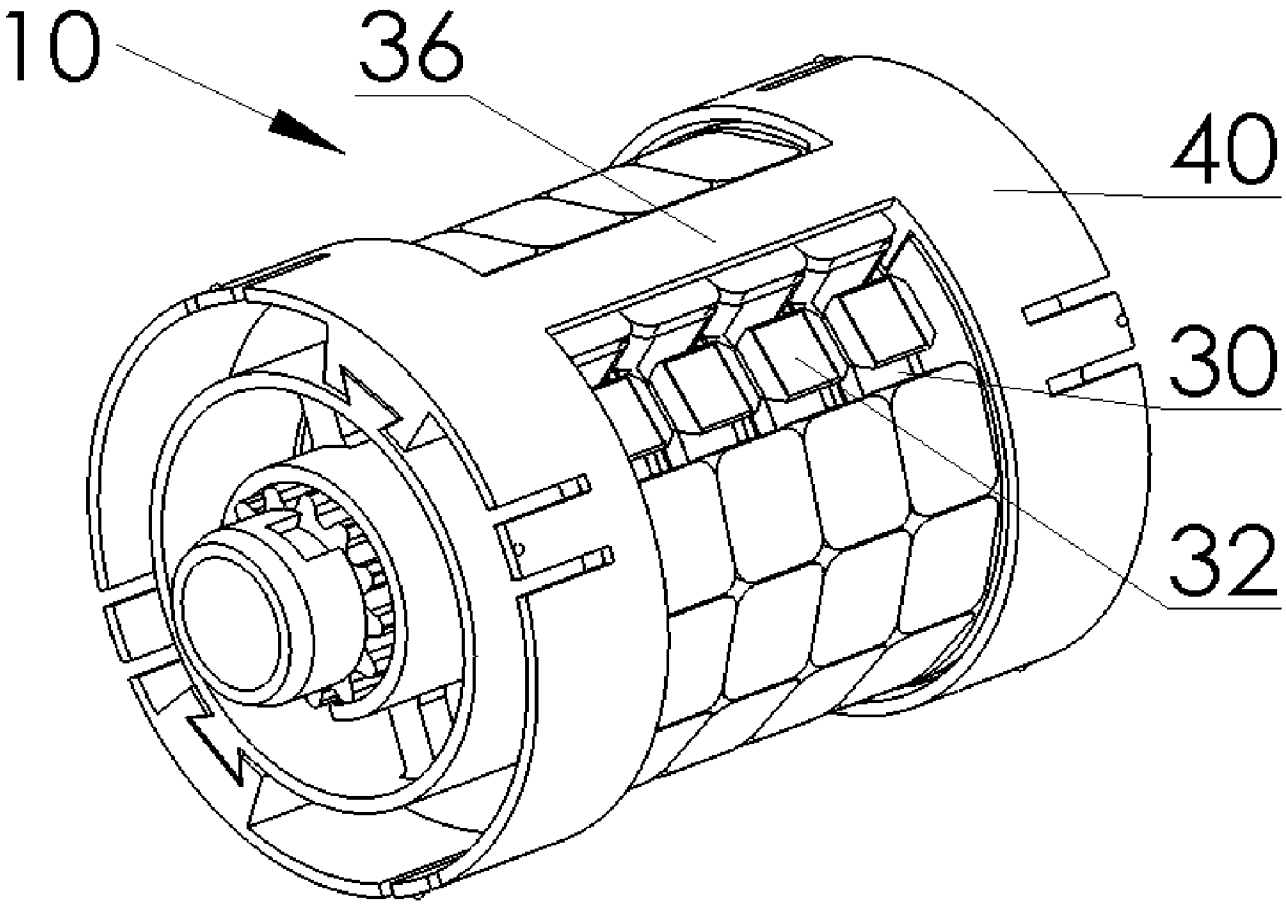
FIG. 11 shows a perspective view of the assembled cylindrical puzzle mechanism of the present invention, with the caps and one longitudinal row of puzzle components removed.

Regarding the manipulation of the puzzle mechanism of the present invention in effort to "solve" the puzzle, with reference to the assembled side view of cylindrical puzzle mechanism (10) shown in FIG. 1*a* (and in FIG. 17*a* as described above), puzzle mechanism (10) is seen in an aligned state, wherein puzzle components (36) are aligned in longitudinal rows between caps (60). In this position, each knob of its respective cantilever spring is disposed within a groove, as described above. FIG. 11 shows a perspective view of the assembled puzzle mechanism of the preset invention, with both caps and one longitudinal row of puzzle components removed for illustrative purposes, to expose a longitudinally aligned row of tracks (32) of wheels (30). It is understood that each longitudinally aligned row of puzzle components similarly comprises a corresponding longitudinally aligned row of tracks. Driving element (47) of cylindrical frame (40) is seen mounted on track (72) of stopper (50).

Figure 12:
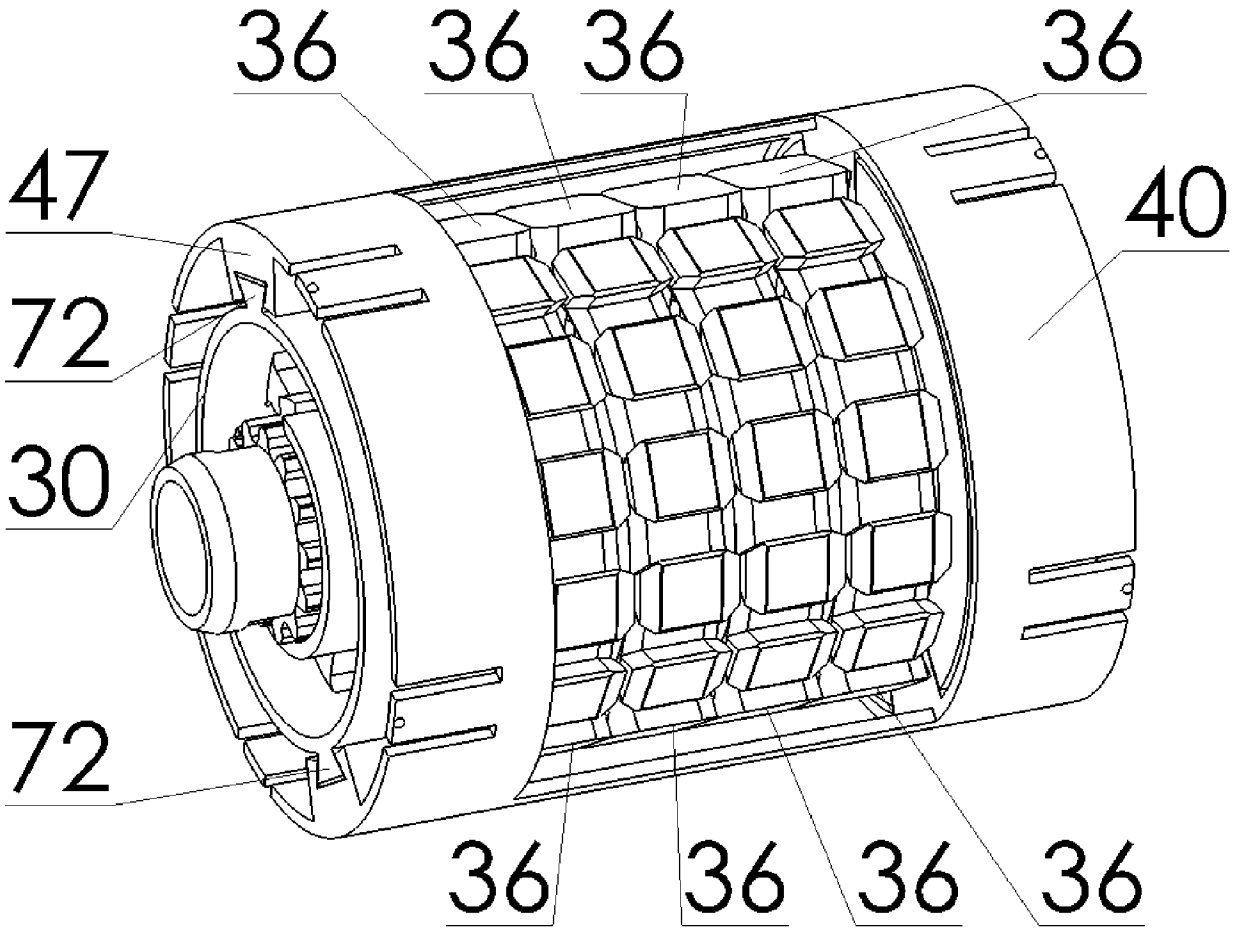
FIG. 12 showing the view of the cylindrical puzzle mechanism of the present invention as seen in FIG. 11, but at a different angle, and wherein all of the puzzle components are removed except for two longitudinal lines of puzzle components.

Referring to FIG. 12, showing the assembled puzzle mechanism (10) in a perspective view similar to that of FIG. 11, but at a slightly different angle, and wherein all of the puzzle components are removed for illustrative purposes, except for two longitudinal lines of puzzle components (36). The two longitudinal lines of puzzle components (36) and their respective tracks are aligned with the tracks (72) of stoppers (50) and driving element (47) of cylindrical frame (40), respectively.

Figure 13:
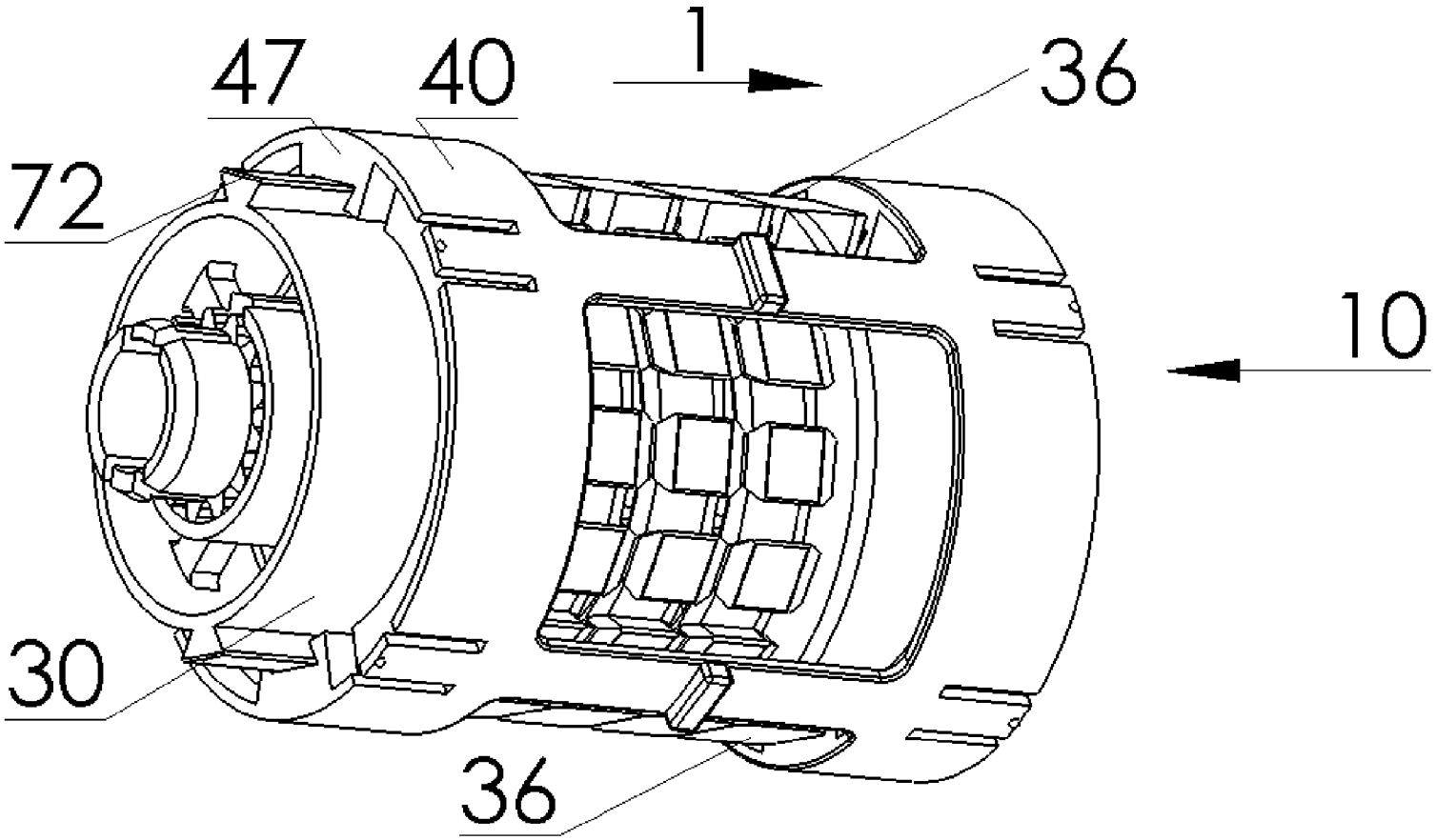
FIG. 13 shows the view of FIG. 13, with the cylindrical frame shifted in an axial direction.
Figure 17B:
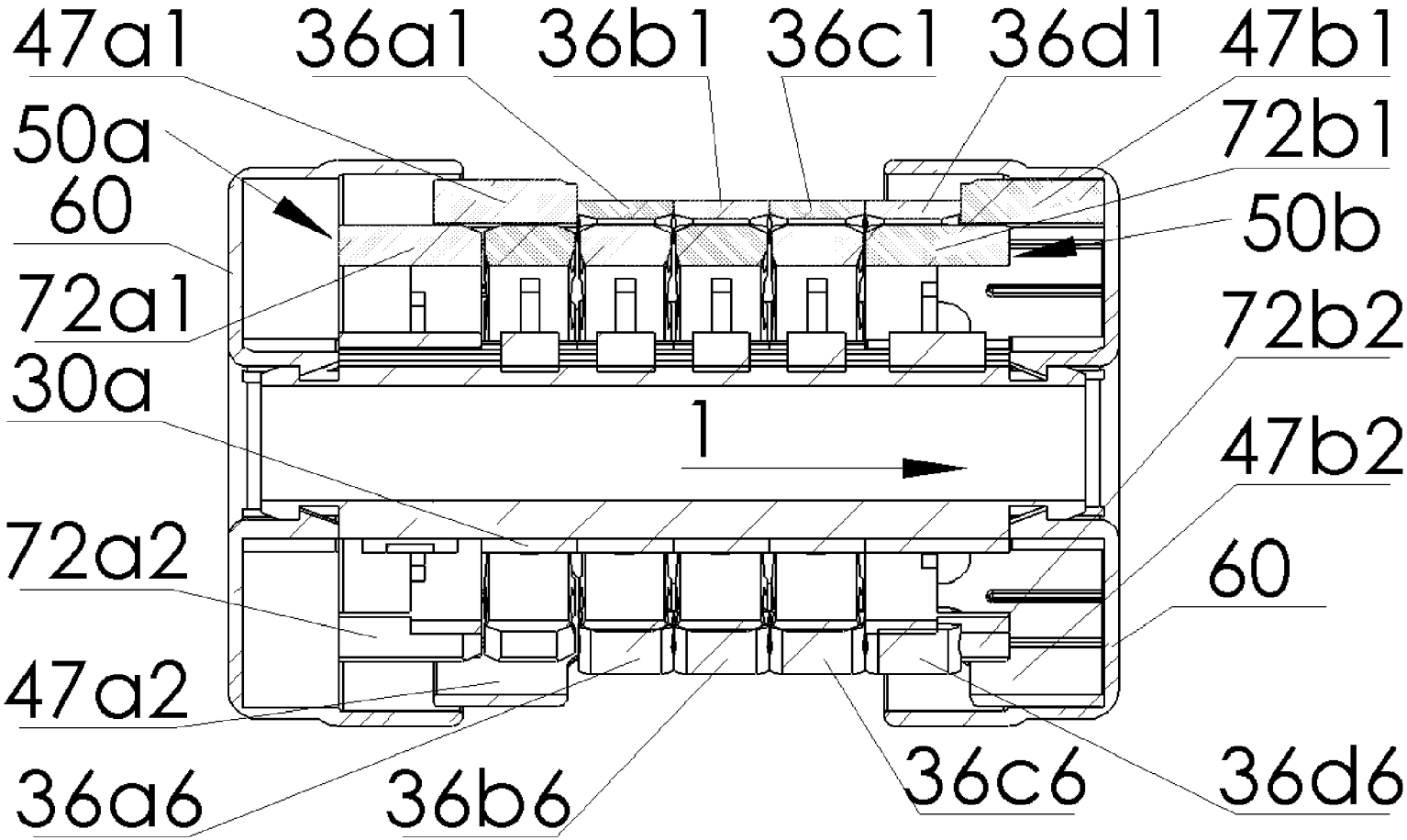

Cylindrical frame (40) can be shifted axially, as seen in FIG. 13 as well as in FIG. 17*b*, showing a longitudinal cross-sectional side view of assembled puzzle mechanism (10) in a shifted (or, final) position, wherein the longitudinal rows of puzzle components (36) is slidingly shifted in the same axial direction as that in which cylindrical frame (40) is shifted, as indicated by arrow (1).

In FIG. 17*b* the longitudinal row of puzzle components, for example (36*a*6-c6), is seen shifted along the wheels. In the shifted position, driving element (47*a*2) is positioned partially mounted on track (72*a*2) of stopper (50*a*) and partially mounted on track (32*a*6) of the adjacent wheel (30*a*). In the preferred embodiment, driving element (47*a*2) is only mounted on the adjacent wheel (30*a*), but in alternative embodiments, the longitudinal length of driving element (47*a*2) may be longer for mounting on additional wheel tracks in the same longitudinal row. At the same time, driving element (47*b*2) is partially mounted on track (72*b*2) of stopper (50). Thus, at all times, the driving elements of the frame are mounted on a respective track of the stopper, thereby coupling the frame with the stoppers. Hence, when the frame is rotated about the shaft, both stoppers rotate concurrently.

Figure 14:
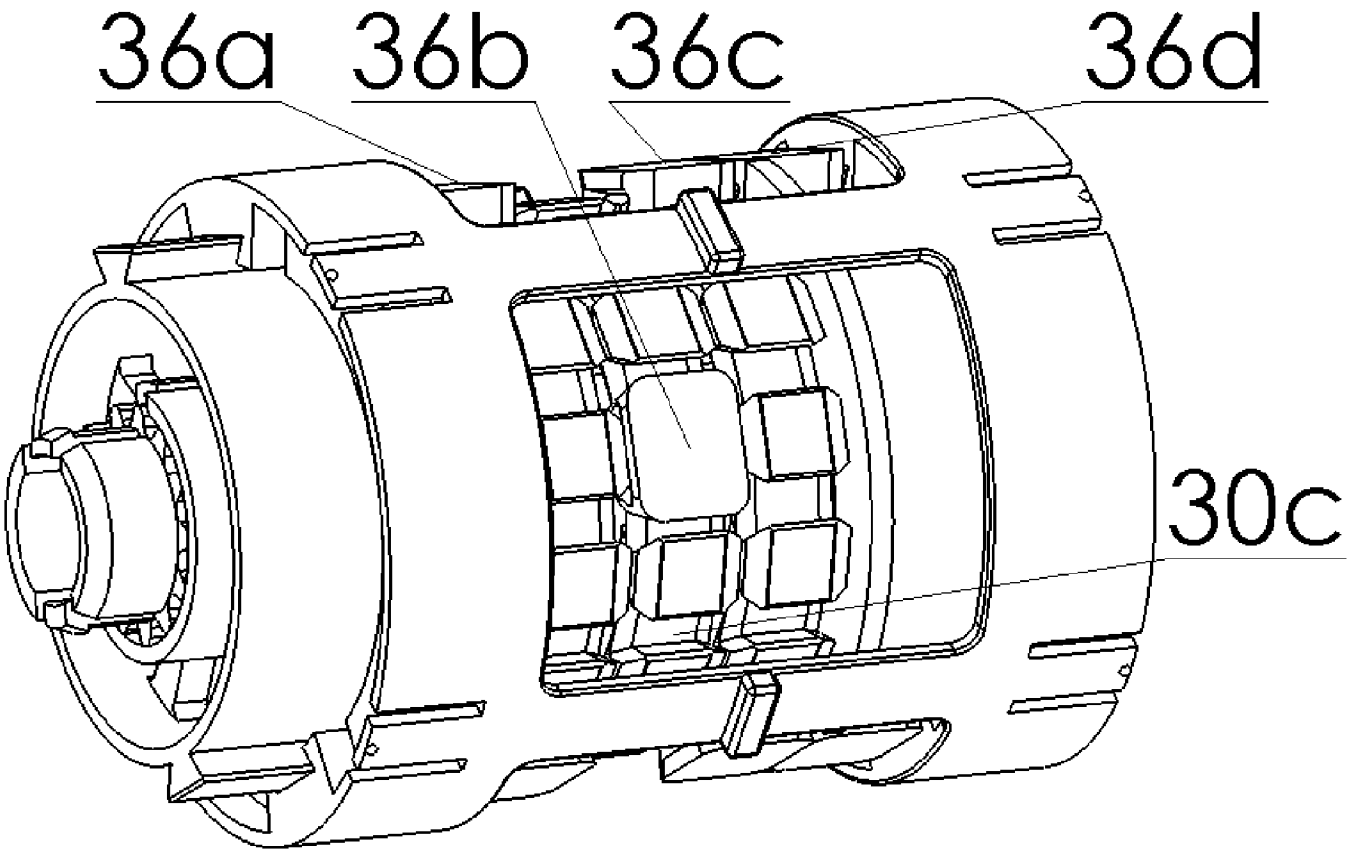
FIG. 14 shows the view of FIG. 13, wherein one wheel is rotated about the shaft.

Upon performing the axial shifting of cylindrical frame (40), wheels (30) may be rotated about the central axis. FIG. 14 shows one wheel (30*c*) rotated about shaft (20). It should be noted that prior to the axial shifting of cylindrical frame (40), puzzle component (36*c*) was mounted on a track of wheel (30*c*). However, after the longitudinal row is axially shifted, each puzzle component is transferred to an adjacent wheel, such that puzzle component (36*c*) is mounted on wheel (30*d*), and puzzle component (36*b*) is mounted on wheel (36*c*).

The manipulation of every one of the puzzle components can be performed by repeating the steps described above and shown in FIGS. 12-14 and FIGS. 17*a* and 17*b*, including aligning the wheels, axially shifting the cylindrical frame and rotating the wheels. It is understood that the cylindrical frame can be shifted in the opposite axial direction as well, and a similar manipulation of the puzzle components may be performed.

Figure 15:
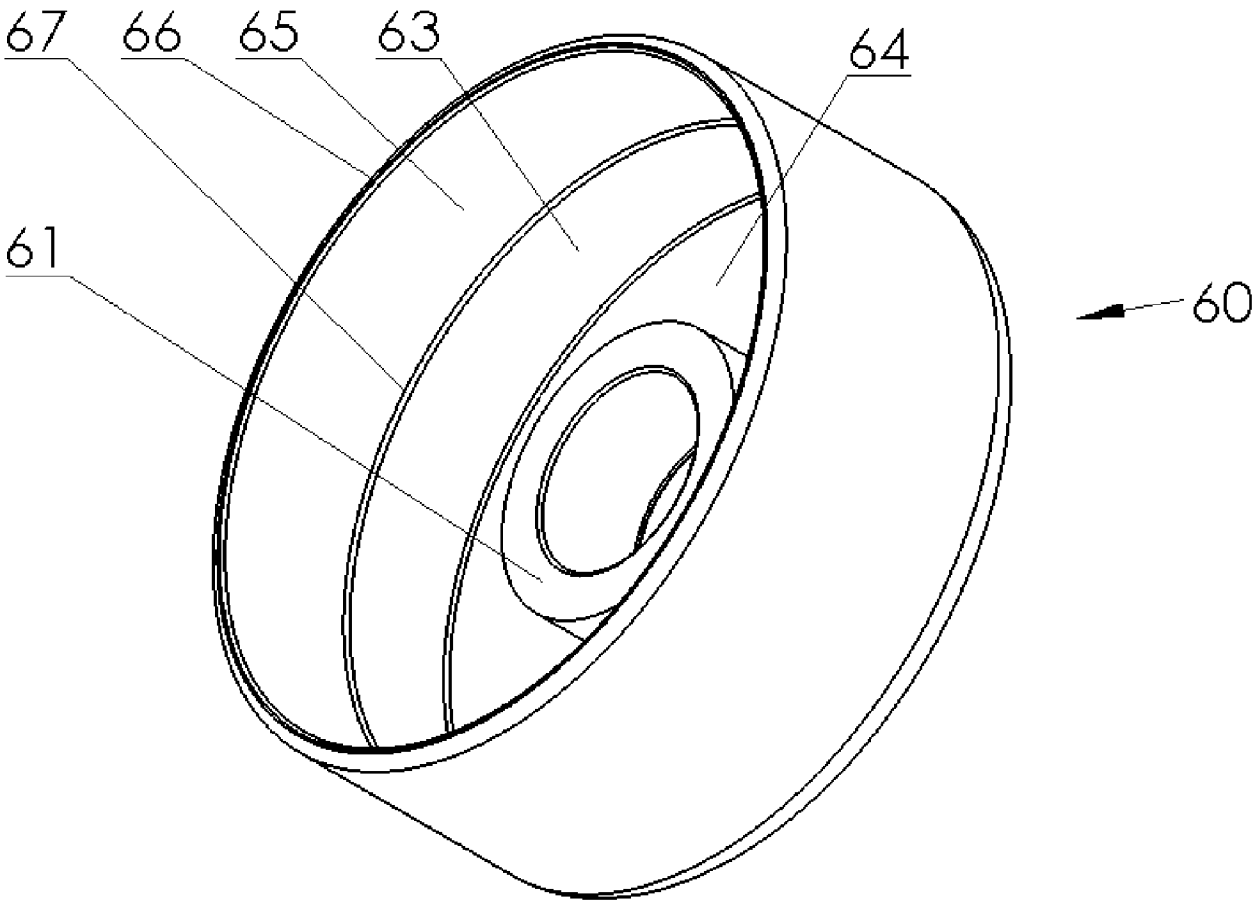
FIG. 15 shows a perspective view of the cap of the present invention.

Referring to FIG. 15, cap (60) is shown in a perspective view, showing the inside of cap (60). Cap (60) comprises a stepped inner circumference, between its back wall (64) and edge (66). The portion (63) closer to back wall (64) comprises a small diameter and the portion (65) closer to edge (66) comprises a large diameter, forming a step (67).

Figure 16A:
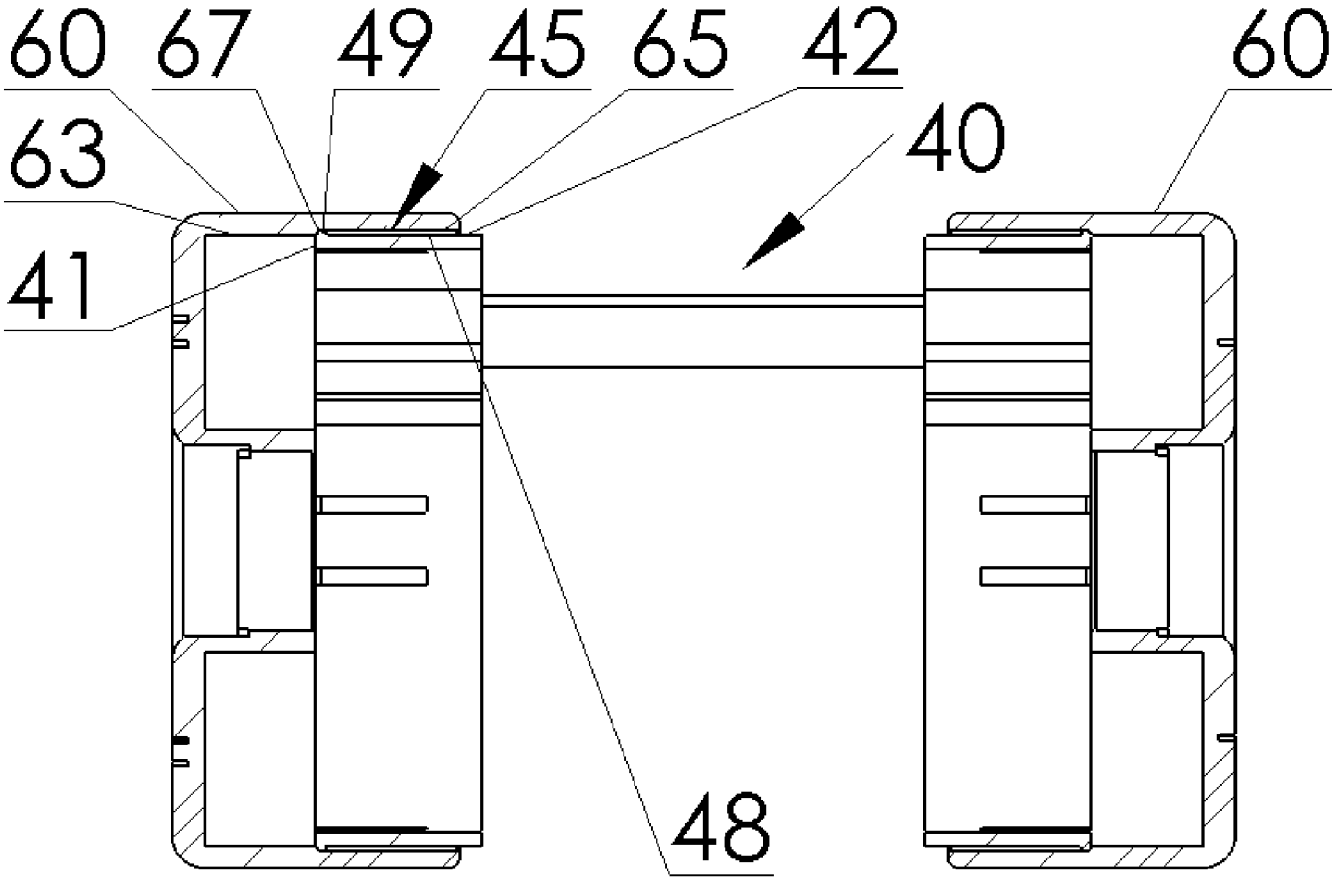
FIGS. 16*a* and 16*b* show a cross-sectional side view of the cylindrical frame disposed within the large diameter portion of a cap (FIG. 16*a*), and within the small diameter portion of a cap (FIG. 16*b*); and, FIGS. 17*a* and 17*b* show a longitudinal cross-sectional view of the assembled puzzle mechanism in a middle (or, initial) position and a shifted (or, final) position.
Figure 16B:
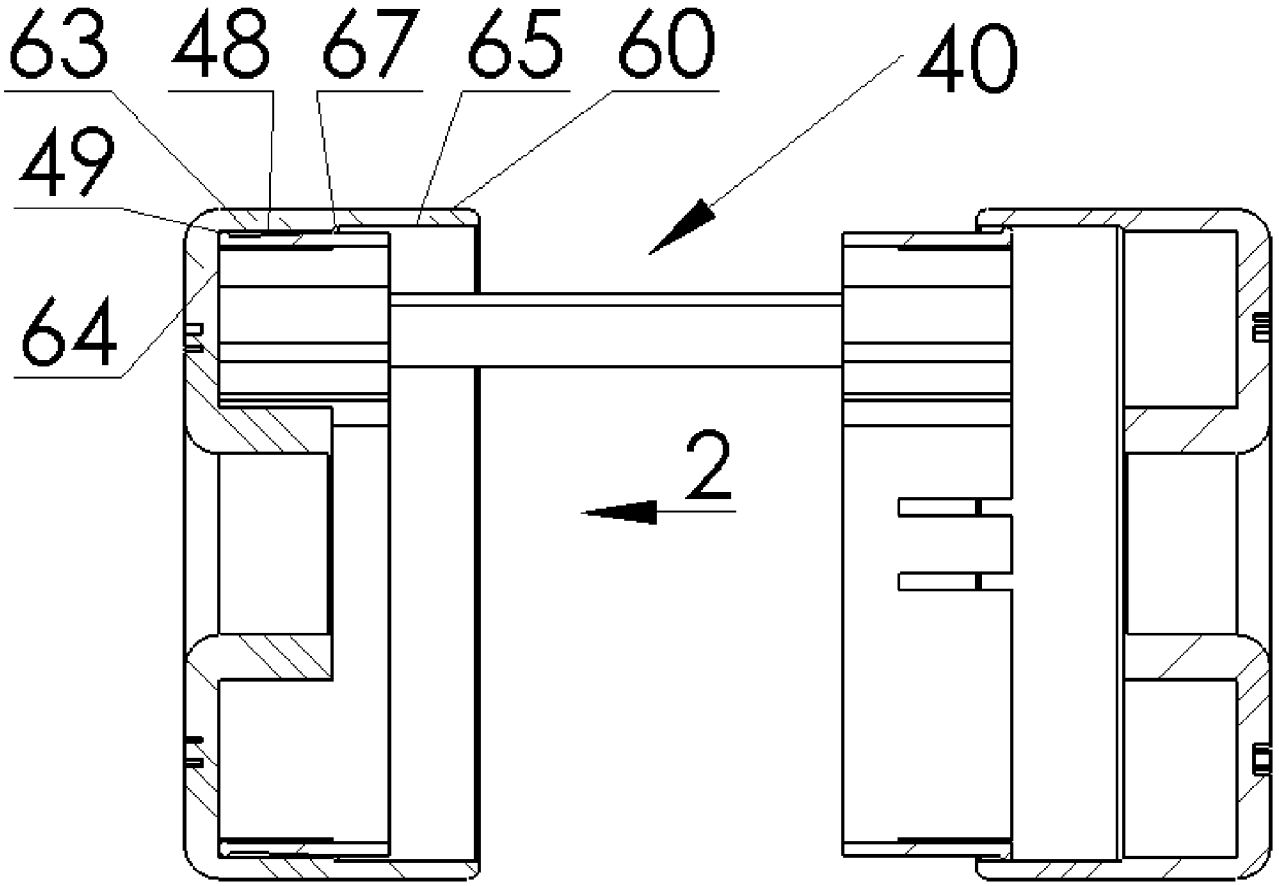

The axial shifting of the cylindrical frame from a middle (initial) position to a shifted end (final) position was described herein above. The movement regulator of the present invention comprises means for maintaining the frame in the middle position (as seen in FIG. 1*a*) when rotating the wheels, yet allowing axial shifting of the frame when a sufficient amount of axial force is applied thereto. Referring to FIGS. 16*a* and 16*b*, showing a longitudinal cross-sectional side view of only the assembled cylindrical frame (40) and cap (60) components, cylindrical frame (40) is in the initial position, and end (41) is seen positioned next to step (67) (FIG. 16*a*). Movement regulator (45) comprises a flap portion (48) cut out from ring (42). The flap portion (48) comprises a small projection (49) for maintaining cylindrical frame (40) in the central position by preventing cylindrical frame (40) from shifting to small diameter portion (63) of cap (60). When a sufficient amount of axial force is applied to cylindrical frame (40) in one axial direction, indicated by arrow (2) in FIG. 16*b*, the flap portion (48) and projection (49) bend inwards toward the central axis of the shaft (not seen in the figure), thereby allowing cylindrical frame (40) to shift toward small diameter portion (63) of cap (60) and contact back wall (64). Flap portion (48) functions like a cantilever spring, which returns to its original position along the radial curvature of ring (42), when cylindrical frame (40) is shifted back to the initial position.

Although only one flap portion (48) and projection (49) were described herein above, two are shown in the figures, and more may be present in alternative embodiments.

It is understood that the above description of the embodiments of the present invention are for illustrative purposes only, and is not meant to be exhaustive or to limit the invention to the precise form or forms disclosed, as many modifications and variations are possible. Such modifications and variations are intended to be included within the scope of the present invention as defined by the accompanying claims.

The invention claimed is:

1. A cylindrical puzzle mechanism comprising:

a. a central shaft member;

b. at least two wheels mounted on said shaft member, wherein each of said wheels is independently rotatable about said shaft member, and wherein a plurality of puzzle components is disposed along the outer circumference of each wheel;

c. a cylindrical frame positioned concentrically around said wheels, wherein said frame is rotatable about said wheels and shiftable along the axial direction of said shaft member, wherein said frame comprises at least one driving element at each longitudinal end for shifting a longitudinally aligned row of puzzle components along an axial direction;

d. two rotatable stoppers for preventing each of said wheels from shifting axially along said shaft, and comprising at least one track for receiving a puzzle component thereon; and, e. a cap at each end of said shaft member for preventing said stoppers from shifting axially along said shaft and for regulating the axial movement of said cylindrical frame.

2. The puzzle mechanism of claim 1, wherein the outer circumference of the shaft member comprises a plurality of grooves extending along the longitudinal length of said shaft, and wherein each wheel comprises an alignment mechanism disposable within one of said grooves, for aligning longitudinal rows of puzzle components.

3. The puzzle mechanism of claim 2, wherein when rotating each wheel about the shaft, the alignment mechanism is alternatingly disposed within adjacent grooves.

4. The puzzle mechanism of claim 3, wherein the alignment mechanism comprises a cantilever spring extending radially, coaxially within the wheel, and comprises a free end disposable within one of the grooves.

5. The puzzle mechanism of claim 2, wherein each wheel has an outer circumference comprising a plurality of tracks on which the plurality of puzzle components are mounted, such that one puzzle component is mounted on each of said tracks.

6. The puzzle mechanism of claim 5, wherein each wheel has an outer circumference comprising thirteen tracks.

7. The puzzle mechanism of claim 6, wherein the number of tracks on each wheel is equal to the number of grooves on the shaft.

8. The puzzle mechanism of claim 6, comprising four wheels.

9. The puzzle mechanism of claim 5, wherein when two tracks of adjacent wheels are axially aligned, puzzle components are slidingly shiftable along said tracks.

10. The puzzle mechanism of claim 9, wherein the cylindrical frame comprises first and second longitudinal ends, wherein each longitudinal end comprises a ring, wherein said rings are spaced apart by at least two longitudinal frame members, thereby exposing the puzzle components of each wheel between said rings and said frame members.

11. The puzzle mechanism of claim 10, wherein at least one driving element is on the inner circumference of each ring, wherein each driving element on one ring is longitudinally aligned along an axial line with a driving element on the other ring, for shifting a row of puzzle components along each of said longitudinally aligned axial lines.

12. The puzzle mechanism of claim 11, comprising between 2-6 driving elements on each ring.

13. The puzzle mechanism of claim 11, comprising between 2-6 tracks on each stopper, wherein the number of tracks on each stopper is equal to the number of driving elements.

14. The puzzle mechanism of claim 11, wherein the cross-sectional contour of the driving element is essentially the same as that of the puzzle component for mounting on the track of a stopper.

15. The puzzle mechanism of claim 12 wherein the cross-sectional contour of the driving element is essentially the same as that of the puzzle component for mounting on the track of a wheel.

16. The puzzle mechanism of claim 11, wherein each ring of the cylindrical frame comprises at least one movement regulator for regulating the axial movement of the cylindrical frame.

17. The puzzle mechanism of claim 16, wherein the cap comprises a large diameter portion and a small diameter portion, wherein a circumferential step is formed between the two said portions, and wherein the movement regulator regulates the axial movement of the cylindrical frame from said large diameter portion to said small diameter portion.

18. The puzzle mechanism of claim 17, wherein the movement regulator comprises at least one flap portion cut out from each ring, wherein each flap portion comprises a small projection in contact with the step portion of the cap for maintaining the cylindrical frame in a middle position by preventing said cylindrical frame from shifting to the small diameter portion of the cap, whereby when a sufficient amount of axial force is applied to the cylindrical frame in one axial direction, the at least one flap portion and projection bend inwards toward the central axis of the shaft, thereby allowing said cylindrical frame to shift to a shifted position wherein one end of said frame is in contact with the back wall of the cap.

19. The puzzle mechanism of claim 17, wherein the cap comprises an extending central ring portion for preventing the stopper elements from shifting axially along the shaft.

20. The puzzle mechanism of claim 19, wherein each longitudinal end of the shaft is coaxially affixed with the central ring portion of one of each cap.

21. The puzzle mechanism of claim 18, wherein the at least one track of each stopper comprises a track for receiving a puzzle component that is slidingly shifted thereon when the at least one driving element axially shifts at least one aligned row of puzzle components.

22. The puzzle mechanism of claim 21, wherein the longitudinal length of the track of the stopper is the same as that of the driving element.

23. The puzzle mechanism of claim 22, wherein the longitudinal length of the track of the stopper is one and a half times the longitudinal length of the track of a wheel.

24. The puzzle mechanism of claim 23, wherein when the cylindrical frame is in the middle position each driving element is mounted on a respective track of the stopper, and when said frame is in the shifted position the driving element at one end of the cylindrical frame is mounted on a track of a wheel and a track of a stopper, and the driving element at the other end of said cylindrical frame is mounted on the track of a stopper.

25. The puzzle mechanism of claim 20, wherein when the cylindrical frame is axially shifted to the shifted position:

a. the puzzle component at a first longitudinal end of the aligned row of puzzle components is mounted on a track of the adjacent stopper;

b. the puzzle component at a second longitudinal end of said longitudinal row is mounted on a track of the wheel adjacent to the wheel on which said puzzle component at said second longitudinal end was mounted prior to the axial shifting of said cylindrical frame; and, c. the driving element of said cylindrical frame at said second longitudinal end is mounted on a track of the wheel on which said puzzle component at said second longitudinal end was mounted prior to the axial shifting of said cylindrical frame;

wherein each wheel excluding said wheel on which said puzzle component at said second longitudinal end was mounted prior to the axial shifting of said cylindrical frame, is rotatable freely about the shaft.

26. The puzzle mechanism of claim 18, wherein each stopper comprises an alignment mechanism disposable within one of the grooves of the shaft, for aligning along an axial line, the at least one track of one stopper with the corresponding track of the other stopper.

27. The puzzle mechanism of claim 21, wherein when rotating the stoppers about the shaft, the alignment mechanism is alternatingly positioned within adjacent grooves.

28. The puzzle mechanism of claim 26, wherein the alignment mechanism comprises a cantilever spring extending radially within the stopper, and comprises a free end disposable within one of the grooves.

* * * * *